US005486240A

United States Patent [19]

McCallum et al.

[11] Patent Number: 5,486,240

[45] Date of Patent: Jan. 23, 1996

[54] CARBIDE/NITRIDE GRAIN REFINED RARE EARTH-IRON-BORON PERMANENT MAGNET AND METHOD OF MAKING

[75] Inventors: R. William McCallum; Daniel J. Branagan, both of Ames, Iowa

[73] Assignee: Iowa State University Research Foundation, Inc., Ames, Iowa

[21] Appl. No.: 232,837

[22] Filed: Apr. 25, 1994

[51] Int. Cl.[6] ..... H01F 1/057

[52] U.S. Cl. ..... 148/102; 148/104; 75/348; 75/349; 419/61; 419/66

[58] Field of Search ..... 148/101, 104, 148/102; 75/348, 349; 419/61, 66; 164/462, 463, 479

[56] References Cited

U.S. PATENT DOCUMENTS

| | | | |
|---|---|---|---|
| 4,597,938 | 7/1986 | Matsuura et al. | 419/23 |
| 4,601,875 | 7/1986 | Yamamoto et al. | 419/23 |
| 4,801,340 | 1/1989 | Inoue et al. | 148/103 |
| 4,919,732 | 4/1990 | Yang et al. | 148/103 |
| 5,172,751 | 12/1992 | Croat | 148/101 |
| 5,240,513 | 8/1993 | McCallum et al. | 148/104 |

*Primary Examiner*—John Sheehan
*Attorney, Agent, or Firm*—Edward J. Timmer

[57] ABSTRACT

A method of making a permanent magnet wherein 1) a melt is formed having a base alloy composition comprising RE, Fe and/or Co, and B (where RE is one or more rare earth elements) and 2) TR (where TR is a transition metal selected from at least one of Ti, Zr, Hf, V, Nb, Ta, Cr, Mo, W, and Al) and at least one of C and N are provided in the base alloy composition melt in substantially stoichiometric amounts to form a thermodynamically stable compound (e.g. TR carbide, nitride or carbonitride). The melt is rapidly solidified in a manner to form particulates having a substantially amorphous (metallic glass) structure and a dispersion of primary TRC, TRN and/or TRC/N precipitates. The amorphous particulates are heated above the crystallization temperature of the base alloy composition to nucleate and grow a hard magnetic phase to an optimum grain size and to form secondary TRC, TRN and/or TRC/N precipitates dispersed at grain boundaries. The crystallized particulates are consolidated at an elevated temperature to form a shape. During elevated temperature consolidation, the primary and secondary precipitates act to pin the grain boundaries and minimize deleterious grain growth that is harmful to magnetic properties.

13 Claims, 32 Drawing Sheets

CARBIDE/NITRIDE GRAIN REFINED RARE EARTH-IRON-BORON PERMANENT MAGNET AND METHOD OF MAKING

CONTRACTUAL ORIGIN OF THE INVENTION

The United States Government has rights in this invention pursuant to Contract No. W-7405-ENG-82 between the U.S. Department of Energy and Iowa State University, Ames, Iowa, which contract grants to the Iowa State University Research Foundation, Inc. the right to apply for this patent.

BACKGROUND OF THE INVENTION

The magnetic properties of a permanent magnet material, such as the known Fe-Nd-B permanent magnet alloy (i.e. Nd2Fe14B), can be separated into two categories: intrinsic and extrinsic properties. Intrinsic properties can be altered by substitution of alloying elements on lattice sites. For example, in the Fe—Nd—B alloy system, the intrinsic magnetic properties can be altered by direct substitution of other elements for the iron, neodymium, or boron sites. U.S. Pat. No. 4,919,732 describes element substitutions that alter magnetic properties for Fe—Nd—B alloys made by rapid solidification using melt spinning. However, generally, enhancing one magnetic property in this manner comes at the price of decreasing another magnetic property.

The extrinsic magnetic properties can be altered by changing the alloy microstructure. For example, by rapid solidification, such as melt spinning and high pressure gas atomization, it is possible to maximize the magnetic properties by forming an extremely fine grain size directly from the melt or by over quenching and crystallizing grains during a short time anneal.

However, there is a problem of maintaining the improved magnetic properties attributable to fine grain structure following consolidation of the rapidly solidified powder or flakes to a magnet shape at high temperatures (such as employed in hot extrusion and hot isostatic pressing) for extended times. During consolidation, the high temperature involved drastically alters (degrades) the extrinsic magnetic properties of the resulting permanent magnet. This degradation defeats the magnetic property advantages achieved by the initial rapid solidification process.

The aforementioned U.S. Pat. No. 4,919,732 describes melt spinning an Nd—Fe—B melt to form rapidly solidified flakes that retain zirconium, tantalum, and/or titanium and boron in solid solution. After the melt spun flakes are comminuted to less than 60 mesh, they are subjected to a recrystallization heat treatment to precipitate diboride dispersoids to stabilize the fine grain structure. The recrystallized flakes are then comminuted to a size of 5 microns or less, cold compacted to a magnet shape under an applied magnetic field, and sintered at high temperature.

A disadvantage associated with the use of melt spinning to rapidly solidify the Nd—Fe—B melt results from the flake shaped particles produced. These particles are difficult to handle and properly consolidate to optimum magnetic properties. As described in the patent, the melt spun flakes are first comminuted to less than 60 mesh size, heat treated, and then further comminuted to less than 5 microns size prior to compaction and sintering.

A disadvantage associated with use of precipitated diborides of hafnium, zirconium, tantalum, and/or titanium to slow grain growth is the alloy competition between using the boron to form the boride and using the boron to form the 2-14-1 phase. This means that during alloying extra boron needs to be added to compensate for this effect which changes the location on the ternary Nd—Fe—B phase diagram and the resulting solidification sequence. In addition, it is found that the transition metal carbonitrides are more stable than their respective borides in the 2-14-1 type magnets. Furthermore, there is a wide range of stoichiometries found in the transition metal carbonitride precipitates. This greater variability in structure allows more freedom in selecting appropriate heat treating cycles.

SUMMARY OF THE INVENTION

The present invention provides a method of making a permanent magnet wherein 1) a melt is formed having a base alloy composition comprising RE, Fe and/or Co, and B wherein RE is one or more rare earth elements and 2) TR (where TR is a transition metal selected from at least one of Ti, Zr, Hf, V, Nb, Ta, Cr, Mo, W, and Al) and at least one of C and N are provided in the base alloy composition melt in substantially stoichiometric amounts to form a thermodynamically stable compound (e.g. transition metal carbide, nitride and/or carbonitride). The compound is more thermodynamically stable than other compounds formable between the additives (i.e. TR, C and/or N) and the base alloy components (i.e. Re, Fe and/or Co, B) such that the base alloy composition is unchanged as a result of the presence of the additives in the melt.

The melt is rapidly solidified in a manner to form particulates having a substantially amorphous (glass) structure or over quenched microcrystalline structure. For example, the melt can be melt spun to provide rapidly solidified, flake-shaped particulates. Alternately, the melt can be gas atomized to produce rapidly solidified, generally spherical powder. The invention is not limited to these particular rapid solidification techniques, however, and can be practiced using other rapid solidification techniques that produce alloy particulates having an amorphous or microcrystalline structure.

In the practice of the invention, the presence of the transition metal additive(s) (e.g. Ti, Zr, Hf, V, Nb, Ta, Cr, Mo, W, and Al) in the melt advantageously affects the glass forming behavior. That is, a much slower melt cooling rate can be used to achieve an amorphous structure. Thus, alloy component modifications (i.e. amount of TR added) can be used to alter the glass forming ability to insure the desired amorphous structure is achieved in the rapidly solidified particulates.

Furthermore, the presence of the transition metal additive(s) causes a lowering of the optimum cooling rate needed to obtain maximum magnetic properties, such as energy product. Thus, the alloys optimum cooling rate can be altered to match the average cooling rate obtained by a particular rapid solidification process so that the optimum magnetic properties can be achieved directly upon solidification.

Moreover, the presence of the transition element additive(s) in the melt advantageously lowers properitectic iron formation during solidification by reducing the amount of melt undercooling necessary to avoid the peritectic reaction. That is, the formation of properitectic iron can be depressed to much lower cooling rates by the presence of the transition metal(s) in the melt.

Primary TRC, TRN and/or TRN/C (carbonitride) precipitates form from the liquid melt during rapid solidification thereof and thus are distributed throughout the amorphous structure of the rapidly solidified particulates.

The particulates are heated above the crystallization temperature of the base alloy composition to nucleate and grow a hard magnetic phase to an optimum grain size and to form finer, secondary TRC, TRN and/or TRN/C (carbonitride) precipitates dispersed at grain boundaries. The fine precipitates form during the crystallization heat treatment from the amorphous, supersaturated solid solution, as opposed to the coarser primary TRC, TRN and/or TRN/C (carbonitride) precipitates that form from the liquid melt during rapid solidification thereof.

The presence of the dissolved transition metal elements in the rapidly solidified structure advantageously increases the crystallization temperature to achieve the hard magnetic phase. Increasing the crystallization temperature changes the nucleation and growth process of the hard magnetic phase since the temperature dependence of the nucleation rate is in accordance with an Arrehnius relation. Higher nucleation temperatures result in more grains of the hard magnetic phase being nucleated per unit of time and provides less opportunity for grain growth until impingement occurs between neighboring grains. A more uniform, finer as-crystallized grain size is realized and imparts higher coercivity and corresponding energy product.

The crystallized particulates are consolidated at an elevated temperature to form a magnet or magnet precursor shape. Consolidation techniques, such as hot pressing, hot extrusion, die upsetting, or others involving the application of pressure at elevated temperatures can be used in the practice of the invention. During elevated temperature consolidation, the primary and secondary precipitates act to pin the grain boundaries and minimize deleterious grain growth that is harmful to magnetic properties.

In one embodiment of the invention, the TR and C and/or N preferably are introduced in elemental form to the melt having the base alloy composition. For an embodiment of the invention using a melt having a base alloy composition including Nd2Fe14B, elemental Ti and C and/or N are provided in substantially stoichiometric amounts to form TiC and/or TiN precipitates.

The present invention will be described in more detail hereafter in conjunction with the following drawings.

DETAILED DESCRIPTION

Figure 1:
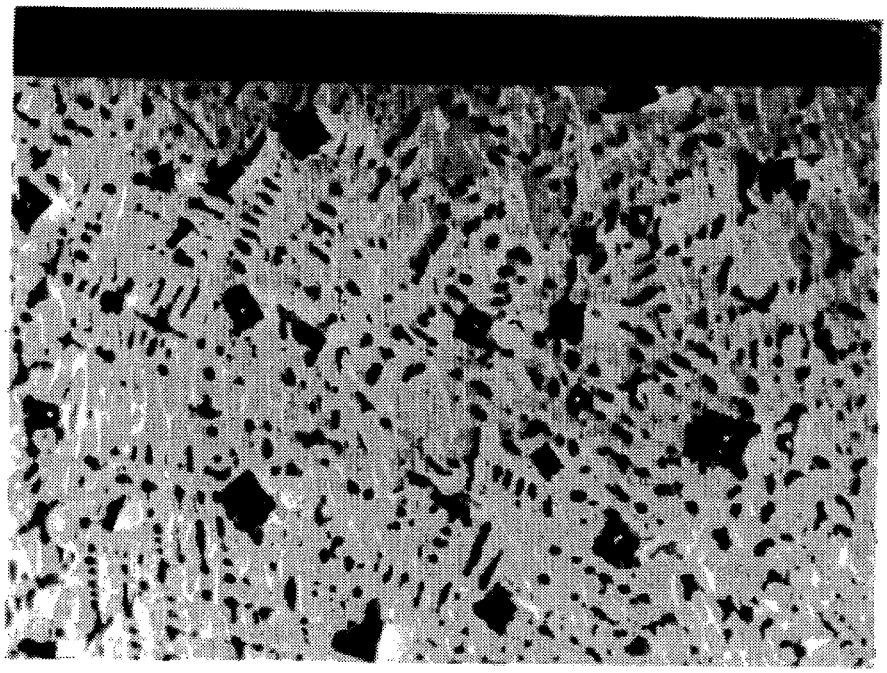
FIG. 1 is a scanning electron micrograph (SEM) at 250× of an as-cast arc-melted Nd2Fe14B alloy including 4 atomic % TiC.

One embodiment of the invention provides an improved method of making a permanent magnet from a base alloy composition comprising RE, Fe and/or Co, and B wherein RE is one or more rare earth elements selected from the group consisting of Y, La, Ce, Pr, Nd, Sm, Er, Gd, Tb, Dy, Ho, Er, Tm, Yb, and Lu. The rare earth elements may be employed singly or in combination in the alloy. The Fe and Co alloy components also can be employed singly or in combination. The base alloy composition preferably includes, in atomic %, 2–30% RE, 50–95% Fe and/or Co, and 0.1 to 25% B.

In accordance with the invention, alloy additives including TR where TR is a transition metal selected from at least one of Ti, Zr, Hf, V, Nb, Ta, Cr, Mo, W, and Al and further including at least one of C and N are provided in the base alloy composition in substantially stoichiometric amounts to form a thermodynamically stable compound, such as TRC when TR and C are included, TRN when TR and N are included, and TRC/N (carbonitride) when Tr and both C and N are included. The compound formed must be more thermodynamically stable than other compounds formable between the alloy additive components (TR, C and/or N) and the base alloy components (Re, Fe and/or Co, B) such that the base alloy composition is unchanged as a result of the presence of additive component in the melt.

For purposes of illustration and not limitation, Ti can be included in the base alloy composition along with C to form TiC compound as precipitates during subsequent rapid solidification and crystallization. The TiC compound is more thermodynamically stable in the alloy according to the observed phase equilibrium than compounds that might otherwise form; e.g. between Ti additive and B in the base alloy composition and between C additive and the Re or Fe and/or Co in the base alloy composition. In this way, the Ti and C can alter characteristics of the melt during rapid solidification (e.g. lowering of required quench rate and of properitectic iron formation as explained below) without substantially altering the base alloy composition by avoiding reaction therewith.

The TR and C and/or N preferably are added in elemental form to the base alloy composition after it is melted, although the invention is not limited in this regard. For example, the Tr and C and/or N can be preformed into the appropriate TRC, TRN and/or TRC/N compounds and added to the melted base alloy composition. The compound then will melt into its elemental components.

The additive components (TR, C and/or N) should have significant solubility in the liquid melt at high temperatures. The specific solubility of the additive component(s) will change the intrinsic properties of the melt and will alter the properitectic iron formation, metallic glass forming ability, and nucleation and crystallization of the metallic glass structure. Moreover, this allows the possibility of solubility in the hard magnetic phase after solidification. Once the solubility limit is exceeded during rapid solidification, primary precipitates of the TR and C and/or N are formed in the amorphous alloy.

The additive components (TR, C and/or N) should have solubility in the hard magnetic phase. The solubility of the TR with C and/or N should be one of only nonequilibrium solubility. This is because the carbon and/or nitrogen essentially draws out the transition metal from the Nd2Fe14B phase to form the transition metal carbonitride precipitates. After crystallization of the metallic glass structure all the additive component(s) precipitate from the supersaturated solid solution in the form of fine precipitates of TRC, TRN, and/or TRC/N (carbonitride) during the crystallization heat treatment. This imparts improved magnetic properties to the hard magnetic phase while enhancing the extrinsic magnetic properties of the microstructure.

Typical preparation of the melt is carried out by charging to an induction melting furnace a master RE-Fe or RE-Co alloy, Fe-B carbo-thermic alloy, and electrolytic Fe with the quantity of each charge controlled to provide the desired base alloy composition. The TR and C and/or N additive alloy components are charged in elemental form or preformed form (transition metal carbonitride) to the melting furnace before or after melting of the base alloy composition.

The melt of the base alloy composition including the TR and C and/or N additive component(s) is rapidly solidified in a manner to form particulates having a substantially amorphous (glass) structure or overquenched micro-crystalline structure; e.g. a grain size up to $10^{-2}$ micron, although larger grain sizes are possible. For example, the melt can be melt spun (cooling rate of $10^3$ to $10^{6\circ}$/second) to provide rapidly solidified, flake-shaped particulates as described in U.S. Pat. No. 4,802,931. Alternately, the melt can be high pressure gas atomized (cooling rate of $10^3$ to $10^{5\circ}$/second) to produce rapidly solidified, generally spherical powder as described in U.S. Pat. No. 5,125,574. However, the invention is not limited to these particular rapid solidification techniques and can be practiced using other rapid solidification techniques, such as centrifugal gas atomization, splat quenching, melt-extraction or others that produce alloy particulates having an amorphous or micro-crystalline structure.

In the practice of the invention, the presence of the transition metal additive component(s) (e.g. one or more of Ti, Zr, Hf, V, Nb, Ta, Cr, Mo, W, and Al) in the base alloy melt advantageously affects alloy glass forming behavior. That is, a much slower melt cooling rate can be used to achieve an amorphous structure. Thus, the amount of TR present in the base alloy melt can be used to alter the cooling rate dependence of glass formation to that inherent with a particular rapid solidification technique being used to insure the desired amorphous structure is achieved in the rapidly solidified particulates. For example, the base alloy composition can include TR additive component(s) effective to enhance the glass forming ability enough so that the highest cooling rate achievable by high pressure gas atomization or other gas atomization techniques, which have a lower maximum cooling rates compared to melt-spinning, result in an amorphous structure.

Furthermore, the presence of the transition metal additive component(s) lowers the optimum cooling rate. The optimum cooling rate is intended to mean the continuous cooling rate during rapid solidification that produces the largest value of energy product in the continuously cooled particulates. This optimum cooling rate is important in that a lower cooling rate will cause a large decrease in the level of hard magnetic properties achievable. Higher cooling rates result in metallic glass formation. Thus, the alloys optimum cooling rate can be altered to match the average cooling rate obtained by a particular rapid solidification process so that the optimum magnetic properties can be achieved directly upon solidification.

Moreover, the presence of the transition element additive component(s) in the melt advantageously lowers properitectic iron formation during rapid solidification by reducing the peritectic cooling range. That is, the formation of properitectic iron can be depressed to much lower cooling rates by the presence of the TR additive component(s) in the melt. Avoidance of the properitectic iron phase is advantageous since large inclusions of free iron phase in the microstructure leads to a diminished level of coercivity due to nucleation of reverse domains.

Primary TRC, TRN and/or TRC/N (carbonitride) precipitates form from the liquid melt during rapid solidification thereof and thus are distributed throughout the amorphous structure of the rapidly solidified particulates. As mentioned above, the thermodynamic stability of the primary precipitates must be greater than that of compounds otherwise formable between the additive components and base alloy components.

The particulates are heated above the crystallization temperature of the particular base alloy composition to nucleate and crystallize a hard magnetic phase to an optimum grain size and to form finer, secondary TRC, TRN and/or TRC/N precipitates dispersed at grain boundaries. The fine precipitates form during the crystallization heat treatment from the amorphous or micro-crystalline, supersaturated solid solution (metallic glass phase) as opposed to the coarser primary TRC/TRN precipitates that form from the liquid melt during rapid solidification thereof. The primary and secondary precipitates must be thermally stable to high temperatures and resist coarsening and dissolution to inhibit deleterious grain growth during subsequent consolidation at elevated temperature.

In the rapidly solidified particulates, the ideal grain size is approximately 50 nanometers, which is below the single domain particle limit of the grains. As the grain size grows larger than the single domain size, there is rapid drop off in coercivity and energy product. Thus, it is important to limit and control grain size in the crystallized particulates. The aforementioned TRC, TRN, and/or TRC/N can slow or prevent unwanted grain growth by pinning the grains during nucleation and growth of the hard magnetic phase and during elevated temperature consolidation of the particulates to a magnet shape or precursor shape.

The presence of the transition metal compound primary precipitates in the solidified structure advantageously increases the crystallization temperature of the hard magnetic phase. Increasing the crystallization temperature changes the nucleation and crystallization kinetics of the hard magnetic phase since the temperature dependence of the nucleation rate is in accordance with an Arrehnius relation. A higher nucleation temperature results in a greater number of grains of the hard magnetic phase being nucleated per unit of time and provides less opportunity for grain growth until impingement occurs between neighboring grains. A more uniform, finer as-crystallized grain size is realized and yields imparts higher coercivity and corresponding energy product.

The crystallized particulates are consolidated at an elevated temperature to form a shape. Consolidation techniques, such as hot pressing, hot extrusion, or die upsetting can be used in the practice of the invention. During elevated temperature consolidation, the primary and secondary precipitates act to pin the grain boundaries and minimize deleterious grain growth that would be harmful to hard magnetic properties.

The Examples set forth below are offered to illustrate and not limit the invention.

EXAMPLE 1

A Nd2Fe14B (atomic formula) melt was formed by charging to an arc furnace suitable amounts of solid Nd, Fe, and B to provide the desired base melt composition. The solid charges were arc-melted under ultra high purity argon on a copper hearth. The base alloy melt was heated until fully molten. Then, 4 atomic % Ti in elemental form and 4 atomic % C in elemental form were added to the base alloy melt. The total melt weight was approximately twenty grams. The melt was flipped and remelted several times to insure a homogenous melt base composition modified with the Ti and C elemental additive components.

The arc-melted alloy sample was contained in a quartz crucible of a melt-spinner with a crucible melt outlet hole diameter of 0.81 mm (millimeters). The melt was induction heated to a melt ejection temperature of 1375° C. The melt was then melt spun at an ejection pressure of 125 Torr onto an underlying copper chill wheel (chill wheel about 5 millimeters below crucible outlet) with a tangential surface velocity of 30 (meters/second). Rapidly solidified, flake-shaped particulates were produced in the size range of 1 to 3 centimeters (typical flake size was flake width of about 1 cm, flake length 1–3 cm and flake thickness 30–40 microns).

FIG. 1 is a scanning electron micrograph (SEM) of an as-cast arc-melted 4 At % TiC alloy. In FIG. 1, it can be seen that square shaped primary TiC precipitates are found in the microstructure. These precipitates formed first from the liquid melt once the solubility limit of Ti and C was exceeded in the liquid phase.

Figure 5:
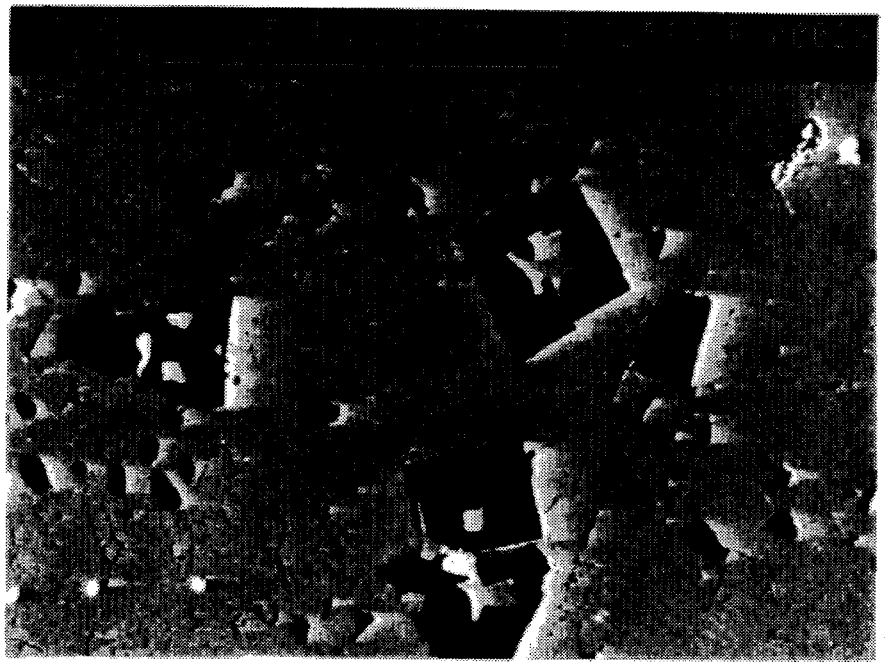
FIG. 5 is an SEM at 787× of the Nd2Fe14B alloy including 4 atomic % TiC of FIG. 1 after heat treatment at 1000° C. for one week.
Figure 6:
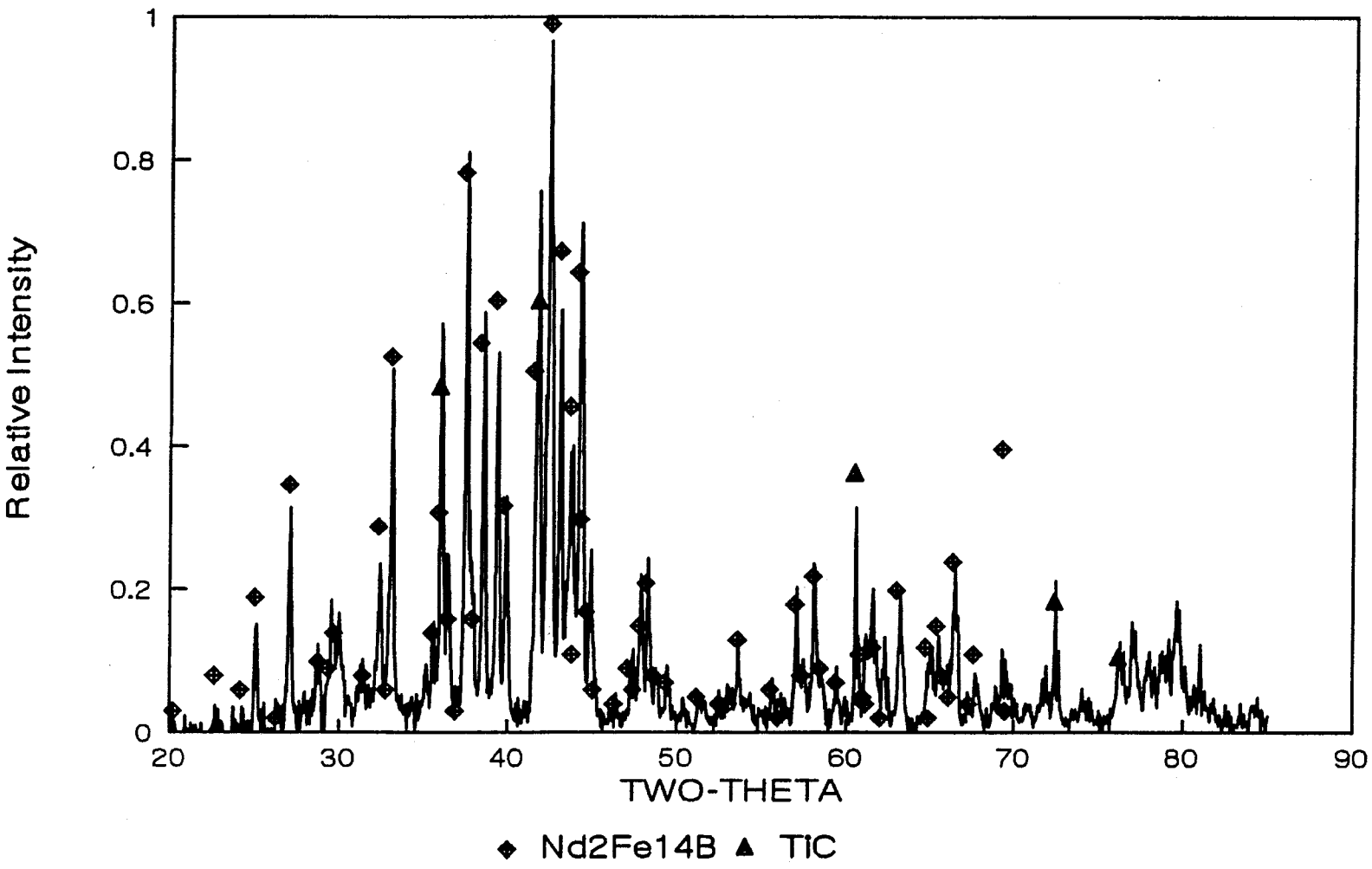
FIG. 6 is an X-ray diffraction scan of the heat treated Nd2Fe14B alloy of FIG. 5 indicating that the homogenized structure comprises Nd2Fe14B and TiC precipitates.

FIG. 5 is an SEM of the Nd2Fe14B alloy including 4 atomic % TiC of FIG. 1 after heat treatment at 1000° C. for one week. It can be seen that the microstructure comprises only two phases. FIG. 6 is an X-ray diffraction scan of the heat treated Nd2Fe14B alloy of FIG. 5. This diffraction scan indicates that the homogenized structure comprises only Nd2Fe14B and TiC phases. These figures indicate that the phase stability of the TiC is higher than any other phases involving the additive components (Ti and C) and base alloy components (Nd, Fe, B).

EXAMPLE 2

A Nd2Fe14B melt was formed by charging to an arc furnace suitable amounts of solid Nd, Fe, and B to provide the desired base melt composition. The solid charges were arc-melted on a water cooled copper hearth. The base alloy melt was heated until fully molten. Then, 6 atomic % Ti in elemental form and 6 atomic % C in elemental form were added to the base alloy melt. The total melt weight was approximately 20 grams. The melt was flipped and remelted several times in the arc-furnace to insure a homogenous melt base composition modified with the Ti and C elemental additive components.

The arc-melted alloy sample was contained in the quartz crucible of the melt-spinner with a crucible melt outlet hole diameter of 0.81 mm. The melt was induction heated until a melt ejection temperature of 1375° C. was obtained. The melt was then melt spun with a crucible ejection pressure of 125 Torr onto the aforementioned copper chill wheel with a surface tangential wheel speed of 25 m/s. Rapidly solidified, flake-shaped particulates were produced in the size range of 1 to 3 cm.

Figure 2:
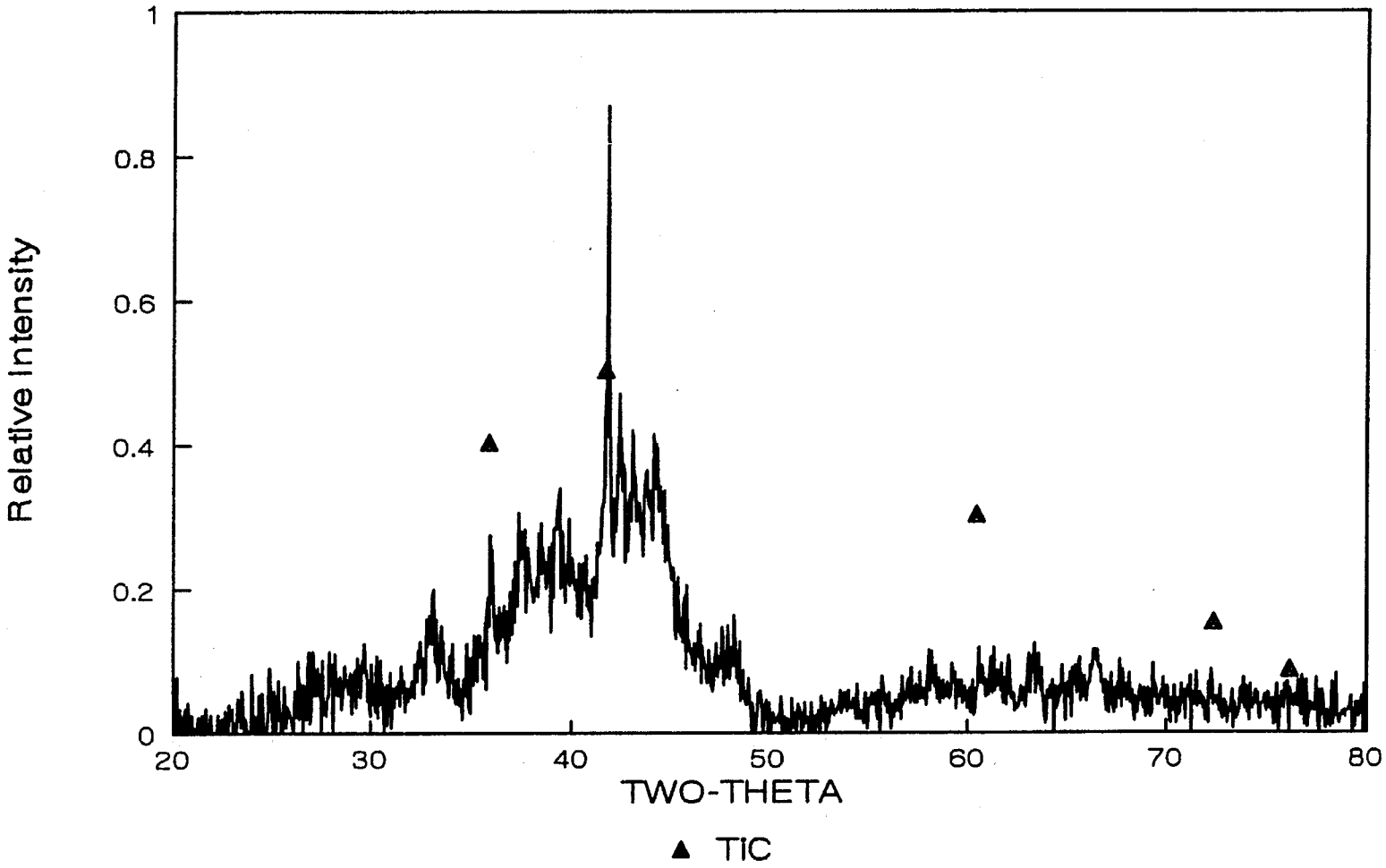
FIG. 2 is an X-ray diffraction scan of a melt spun Nd2Fe14B alloy including 6 atomic % TiC indicating the presence of TiC primary precipitates.

FIG. 2 is an X-ray diffraction scan of the melt spun particulate material including 6 atomic % Ti and C. Primary TiC precipitates are evident in the rapidly solidified metallic glass phase due to their time independent formation from the liquid.

Figure 3:
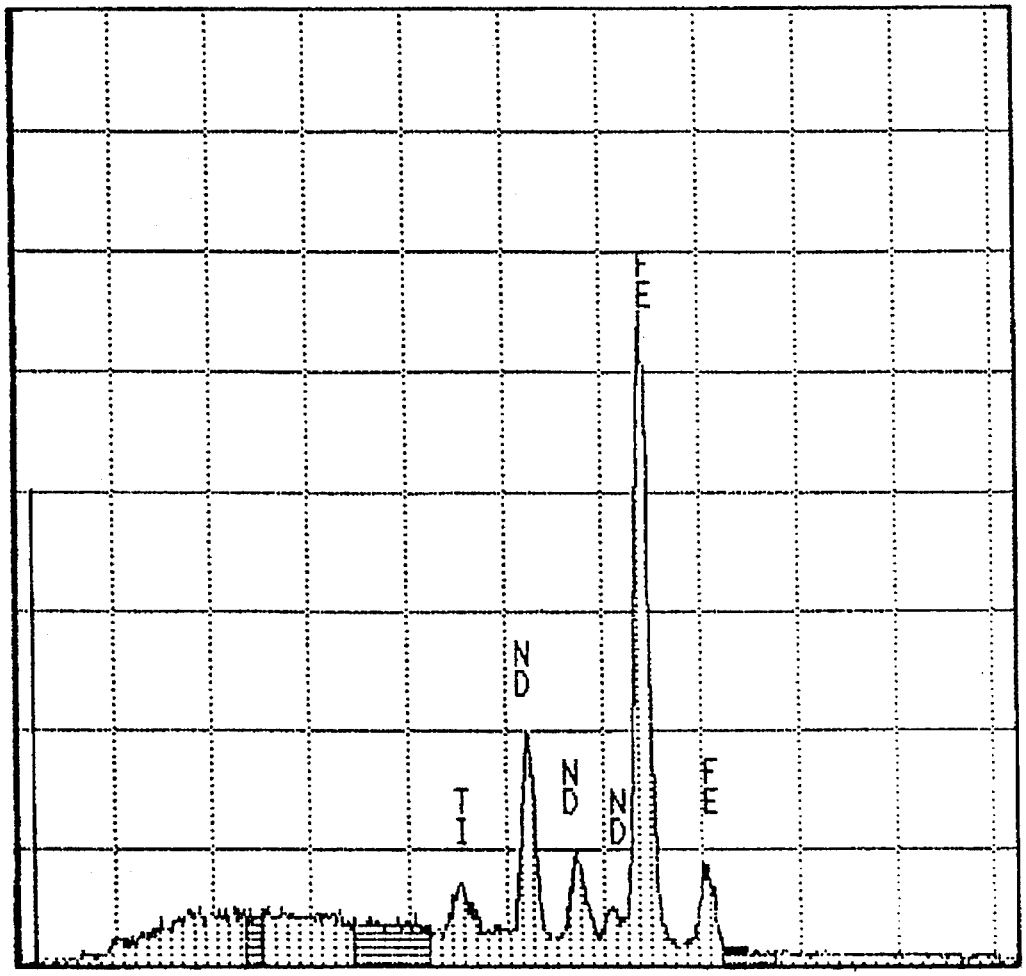
FIG. 3 is an energy dispersive spectroscopy (EDS) of an as-cast Nd2Fe14B alloy including 6 atomic % TiC indicating the presence of elemental titanium in solid solution in the Nd2Fe14B phase.

FIG. 3 is an EDS spectrum of the arc-melted Nd2Fe14B alloy including 6 atomic % TiC indicating the presence of elemental titanium in solid solution in the Nd2Fe14B phase.

Figure 4:
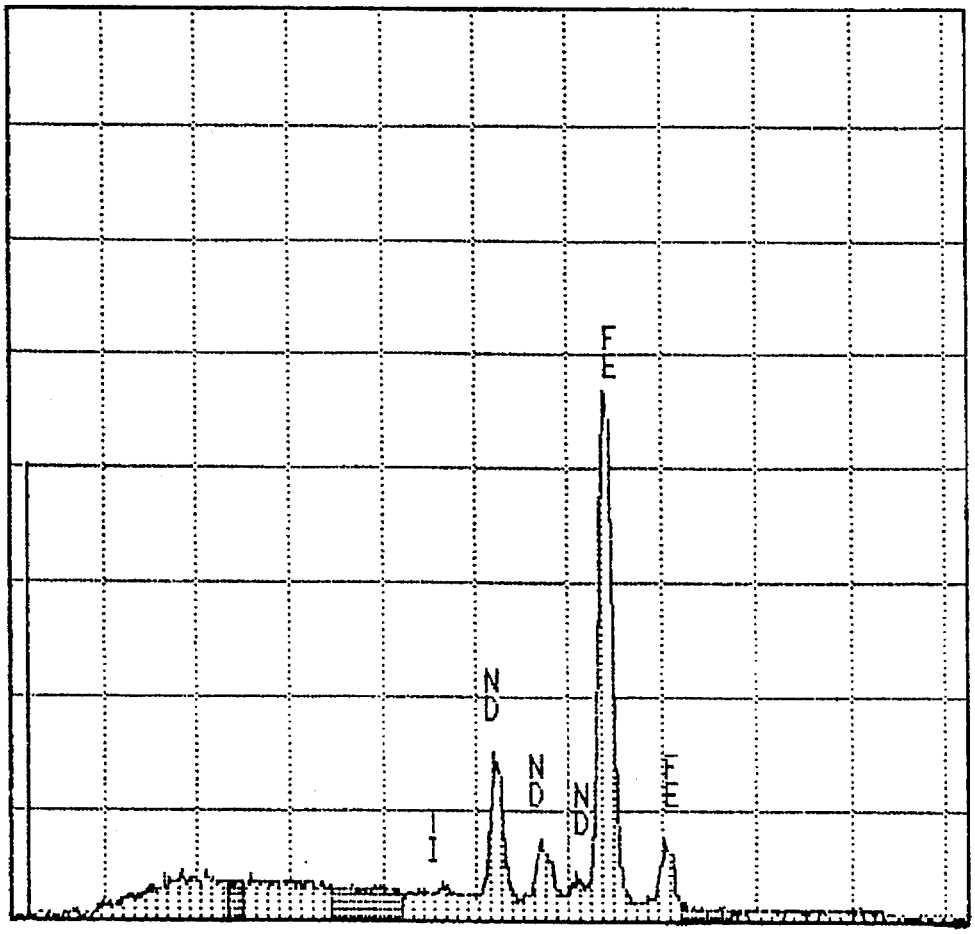
FIG. 4 is an EDS (energy dispersive spectroscopy) scan of an as-cast arc-melted Nd2Fe14B alloy including 6 atomic % TiC after equilibrium heat treatment at 1000° C. for one week indicating that no elemental titanium is present in solid solution.

FIG. 4 is an EDS spectrum scan of the arc-melted Nd2Fe14B alloy including 6 atomic % TiC after equilibrium heat treatment at 1000° C. for one week. The scan indicates that no elemental titanium is present in solid solution. Ti appears to have little or no equilibrium solubility in the hard Nd2Fe14B magnetic phase since Ti is not evident in the EDS spectrum after heat treatment.

EXAMPLE 3

A Nd2Fe14B melt was formed by charging to an arc-melting furnace suitable amounts of solid Nd, Fe, and B to provide the desired base melt composition. The solid charges were arc-melted on a water cooled copper hearth. The base alloy melt was heated until fully molten. An ingot formed by solidifying the base alloy melt was comminuted and arc remelted. Then, 2.4 weight % of AlN was added to the melt in powder form. The AlN powder was made by heating up aluminum powder at high temperature in the presence of nitrogen gas. The total melt weight was approximately twenty grams. The melt was flipped several times to insure a homogenous melt base composition modified with the AlN additive component.

Figure 7A:
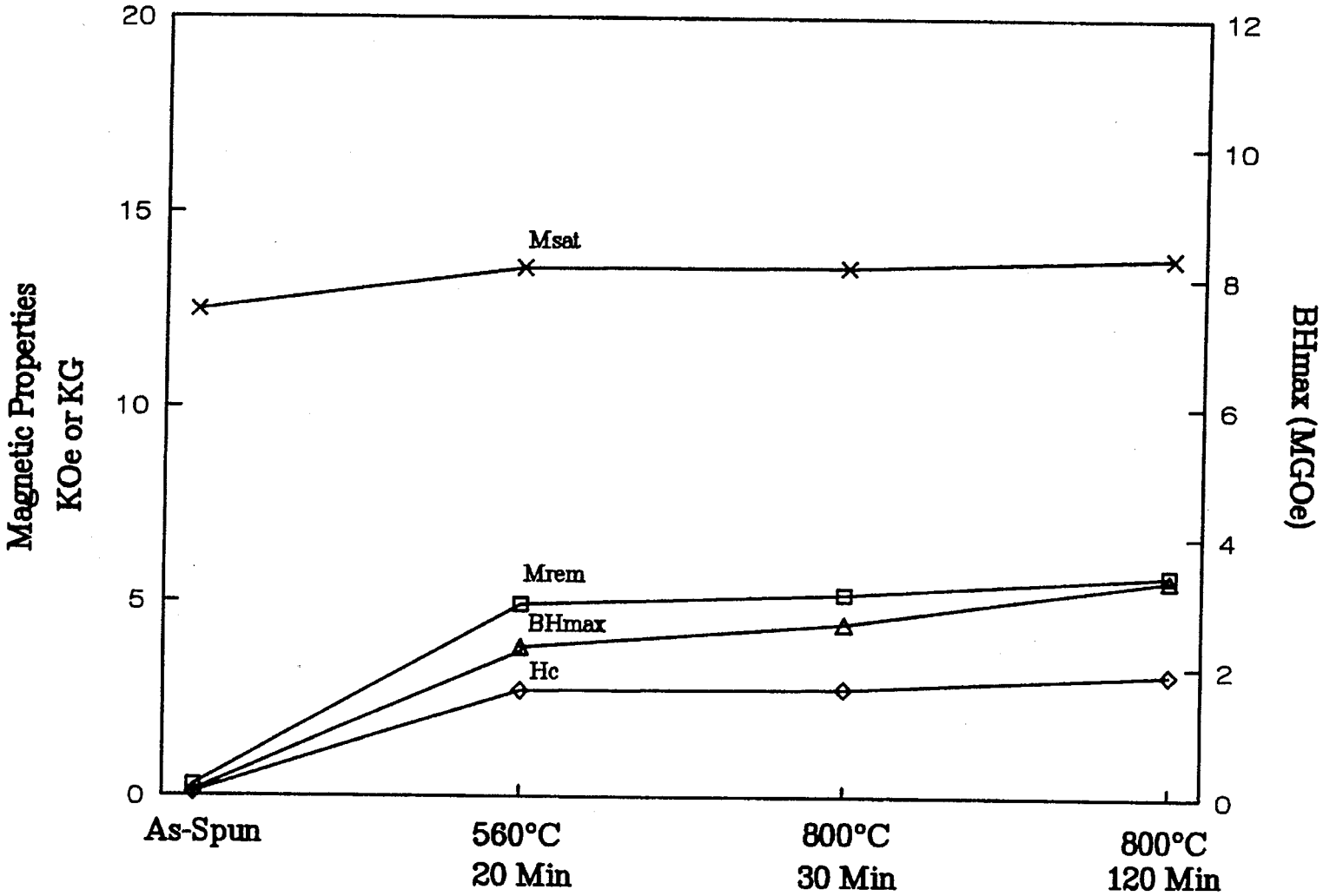
FIGS. 7A–7L are graphs of magnetic properties versus heat treatment times at the temperatures set forth on the respective figures for Nd2Fe14B alloys including 2.4 weight % of transition metal carbonitrides set forth on the figures.
Figure 7B:
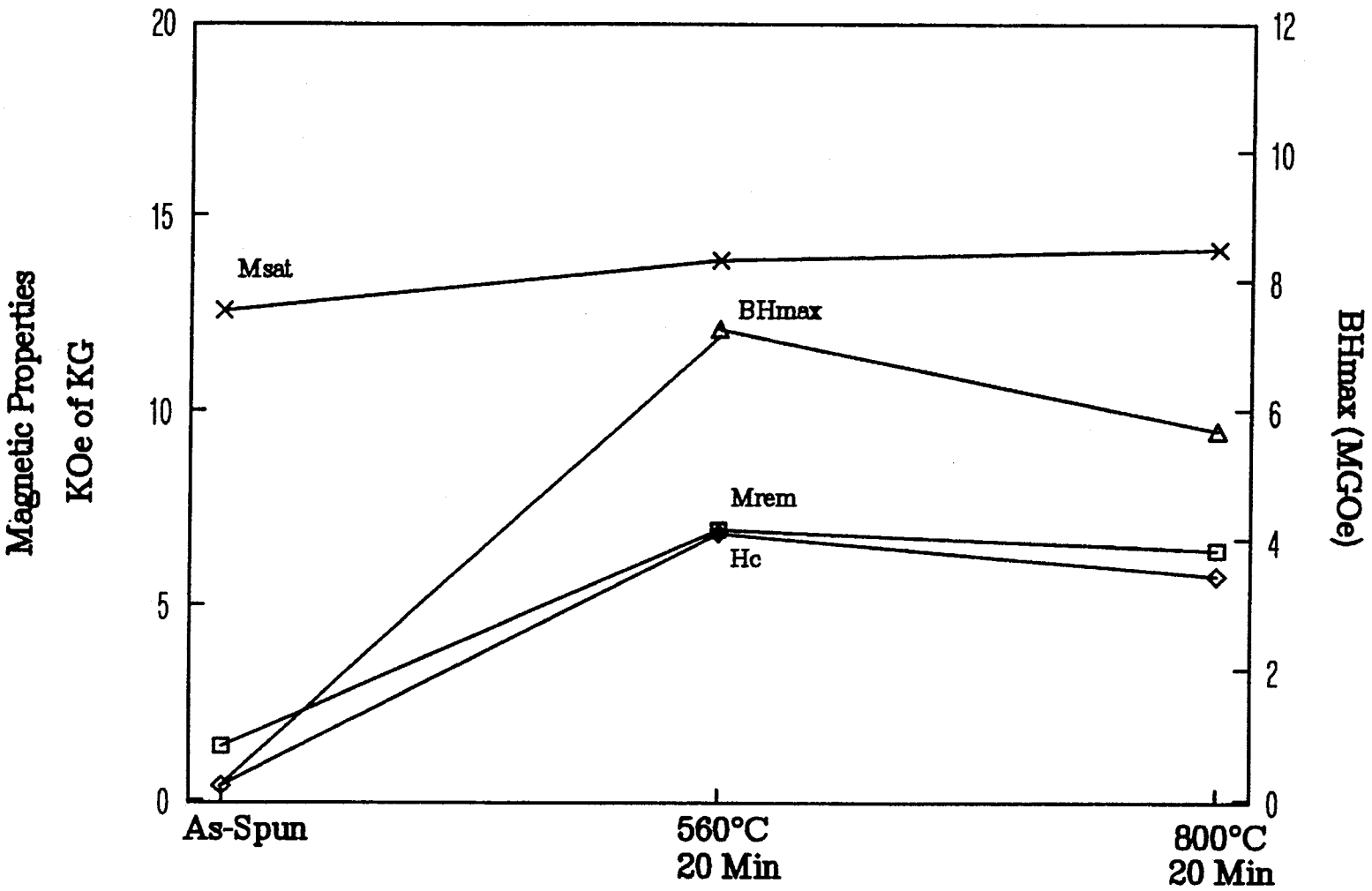
Figure 7C:
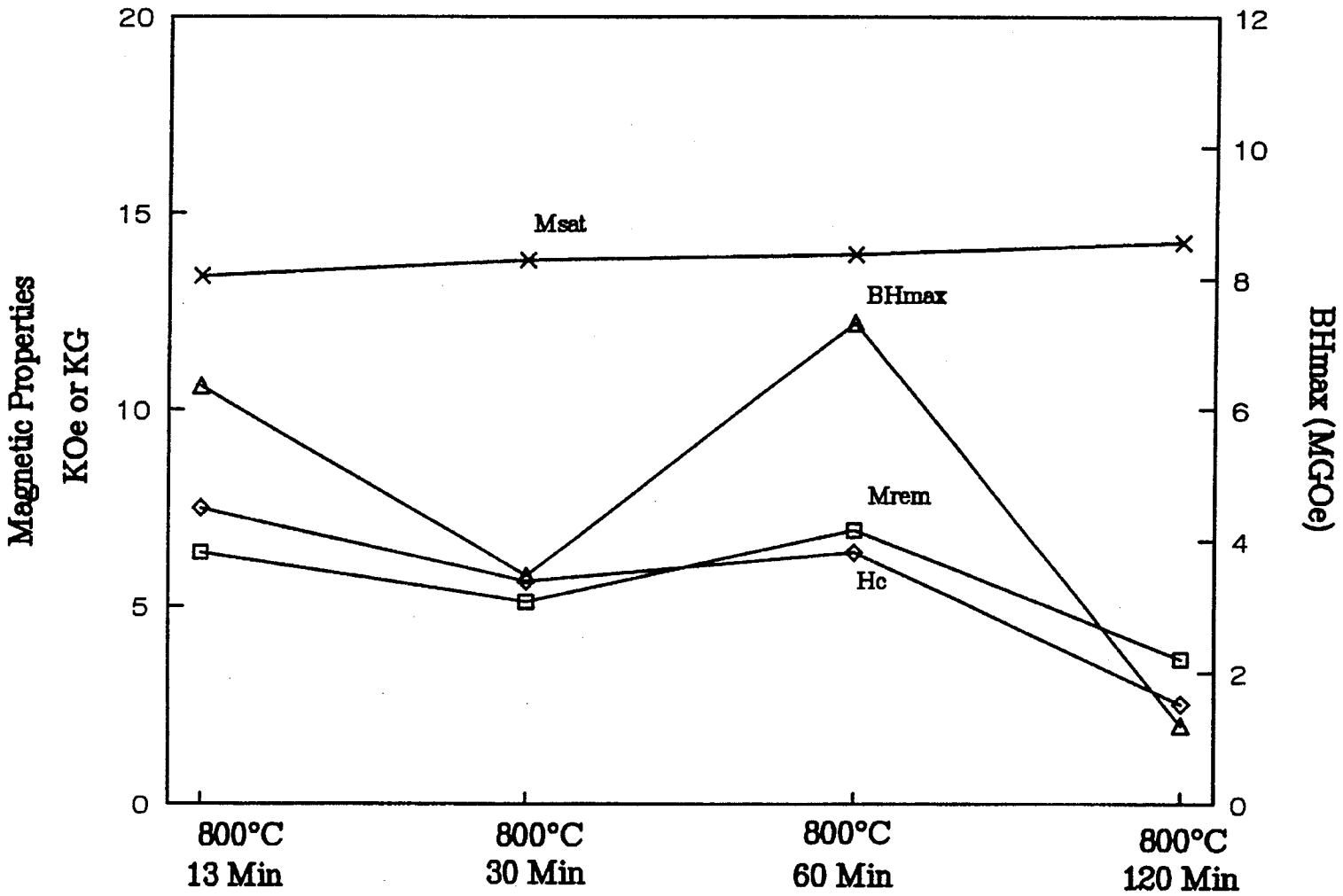
Figure 7D:
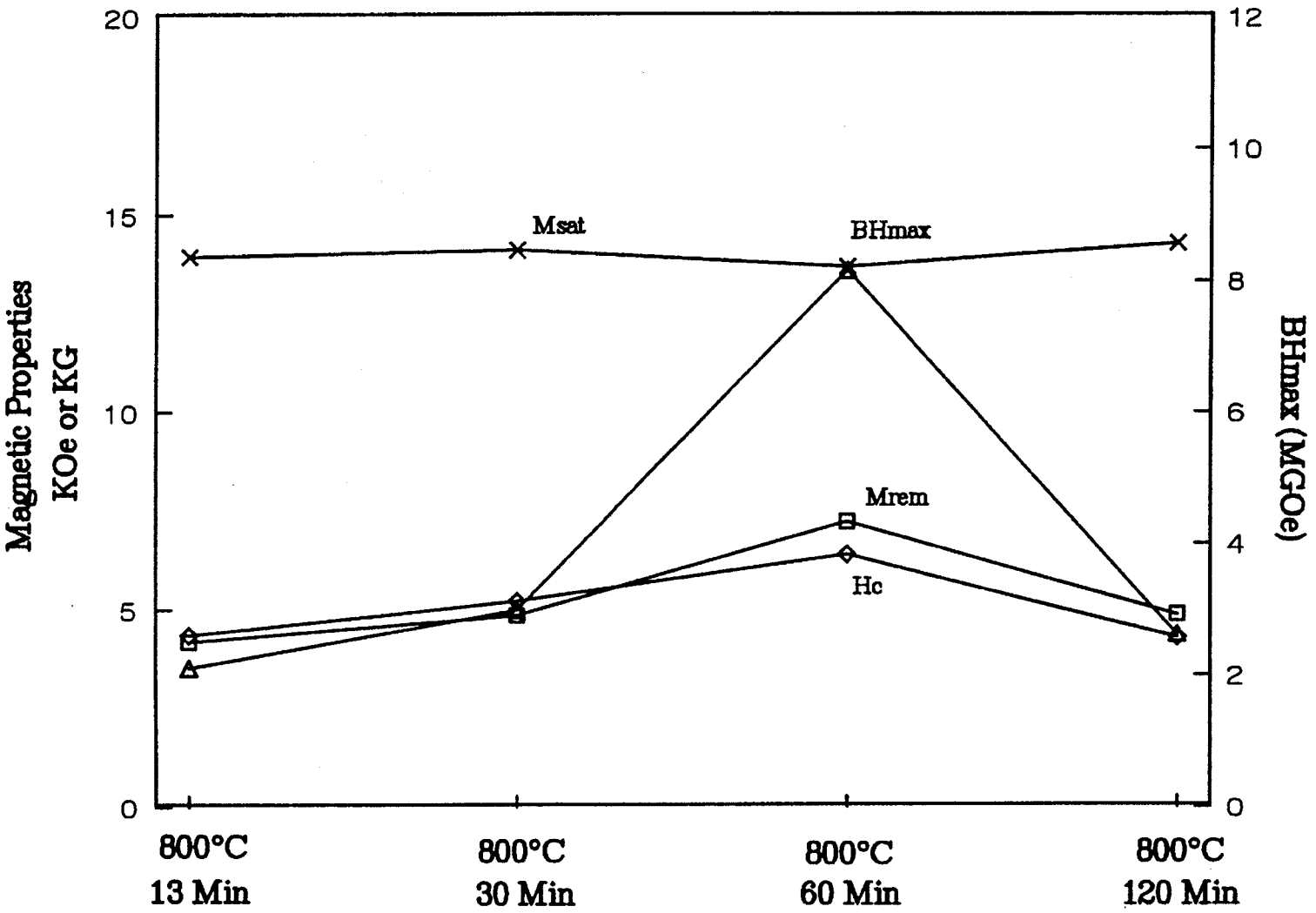
Figure 7E:
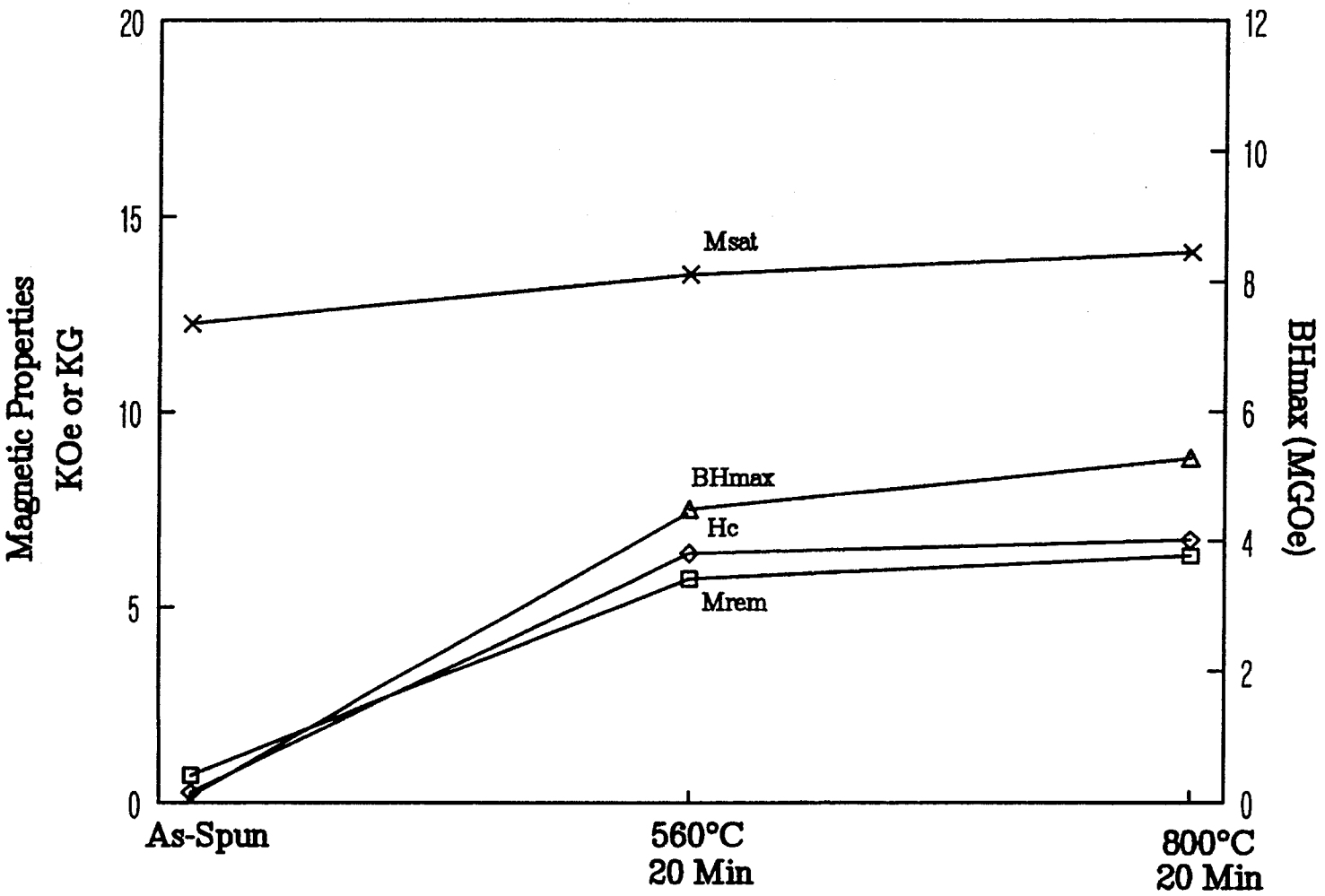
Figure 7F:
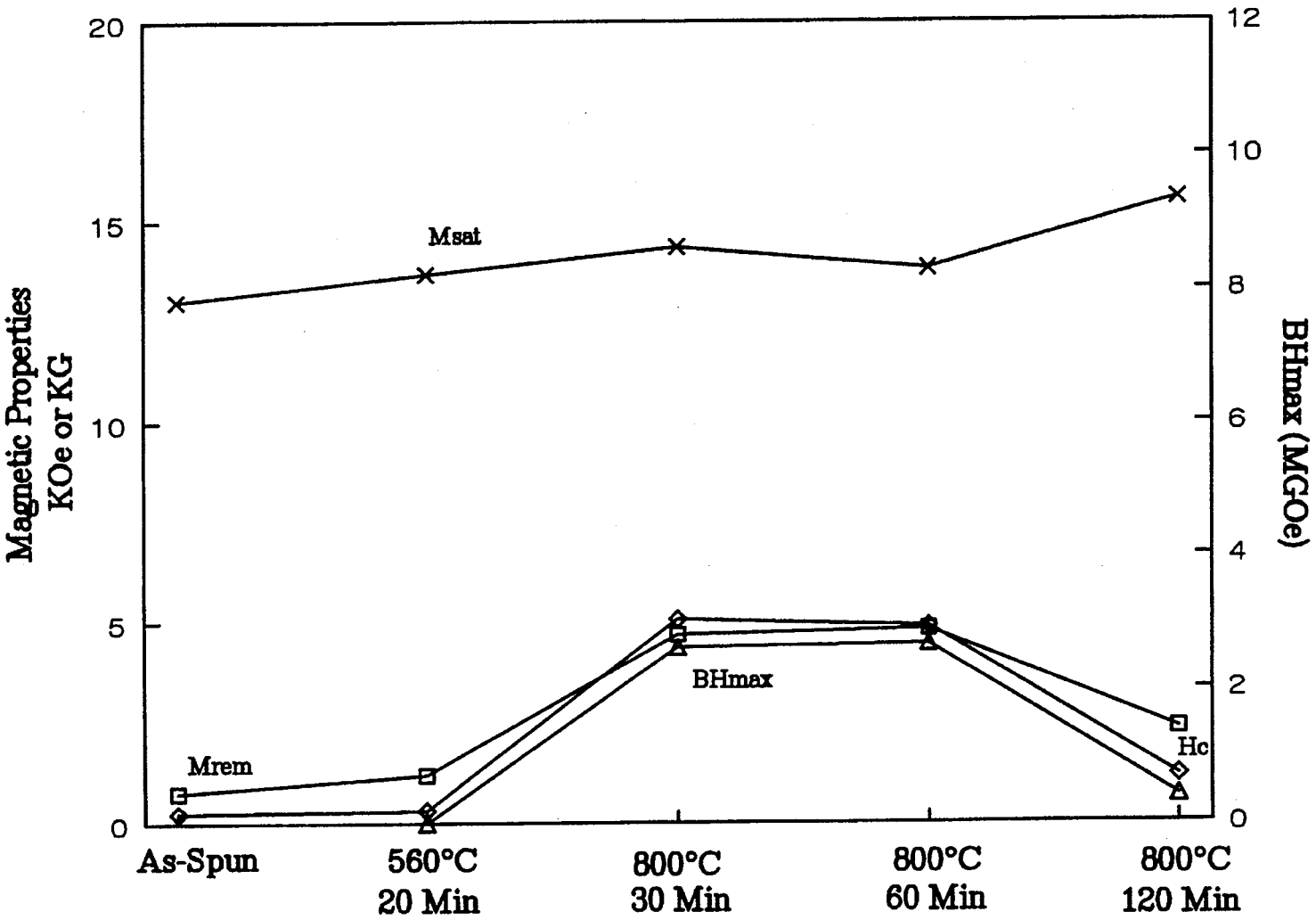
Figure 7G:
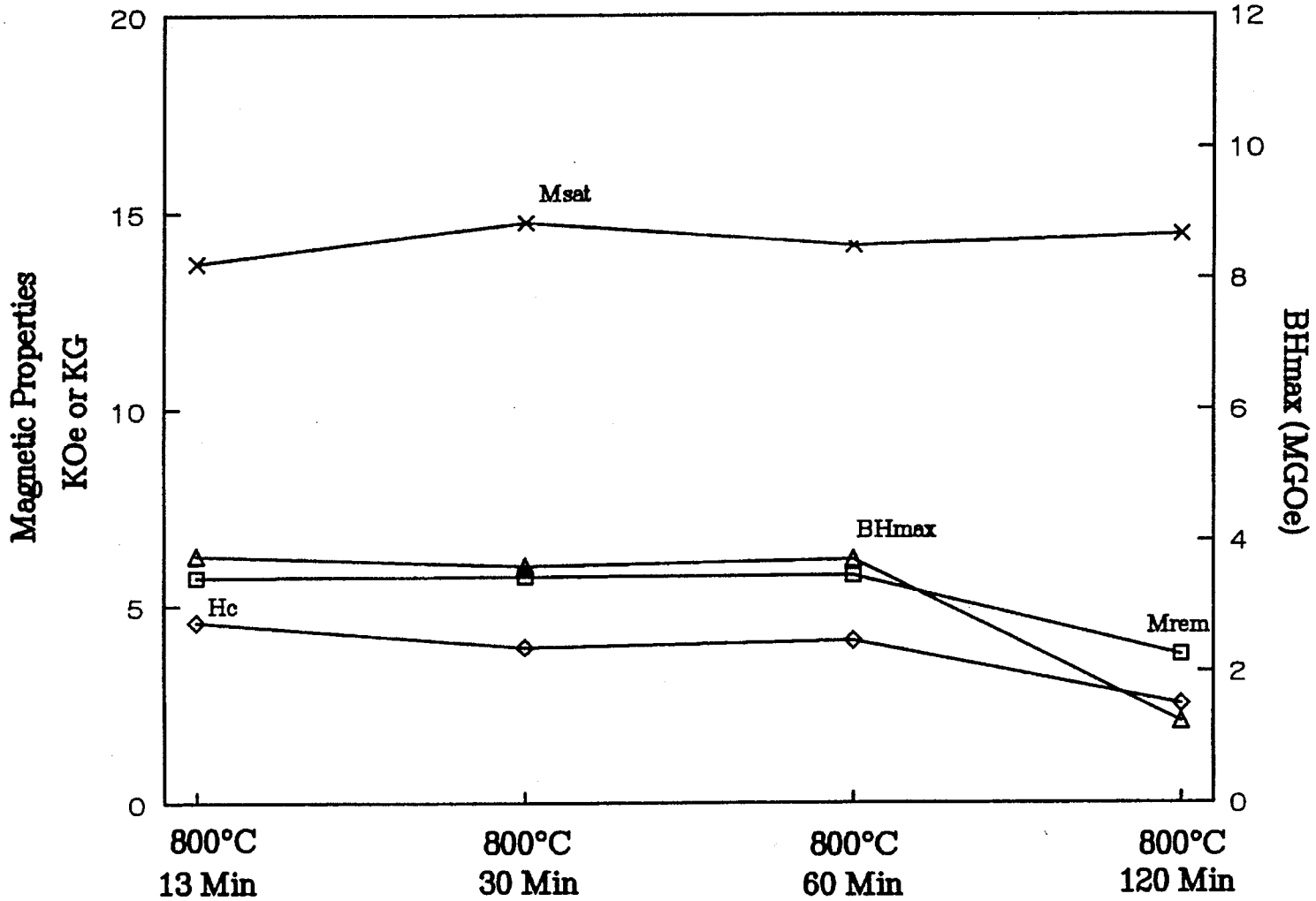
Figure 7H:
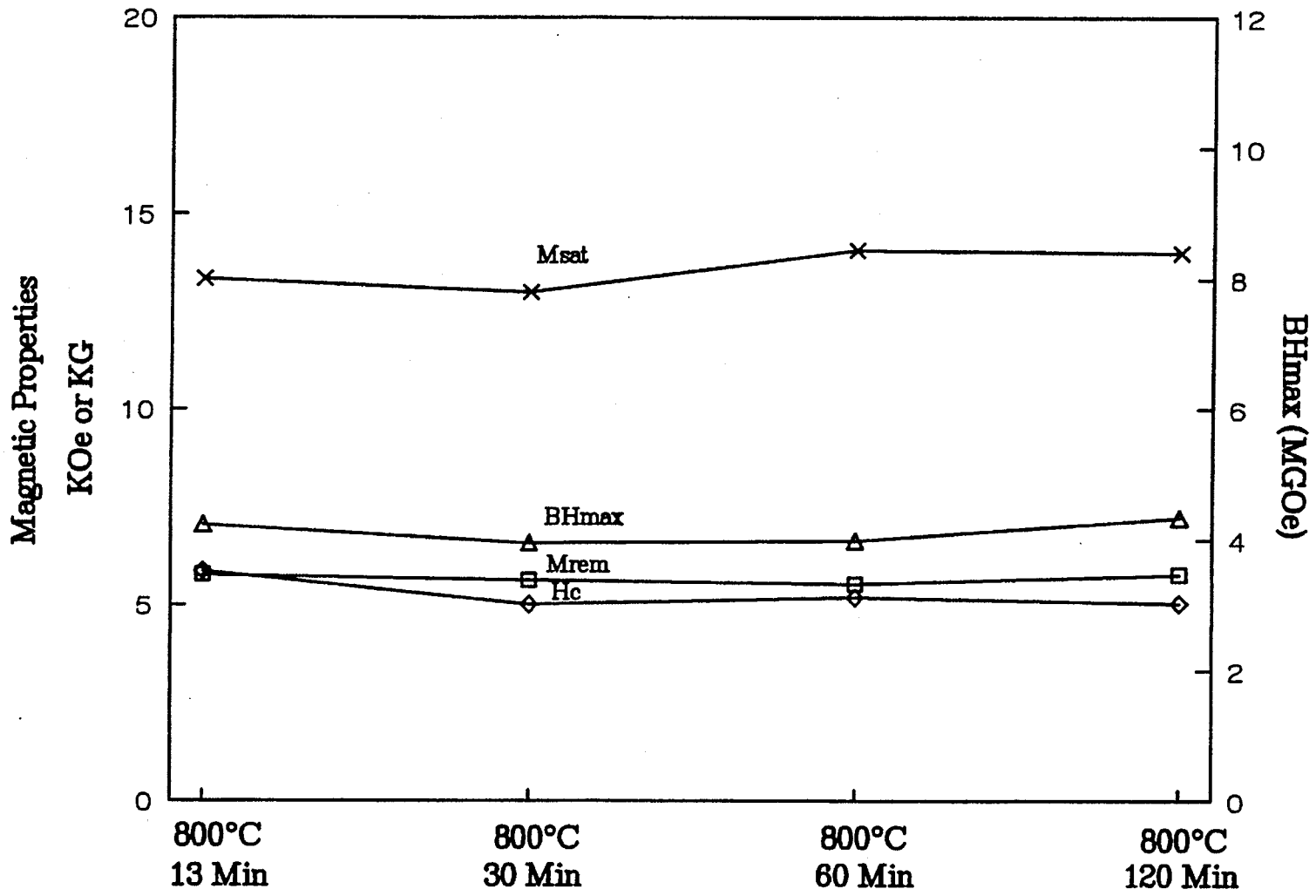
Figure 7I:
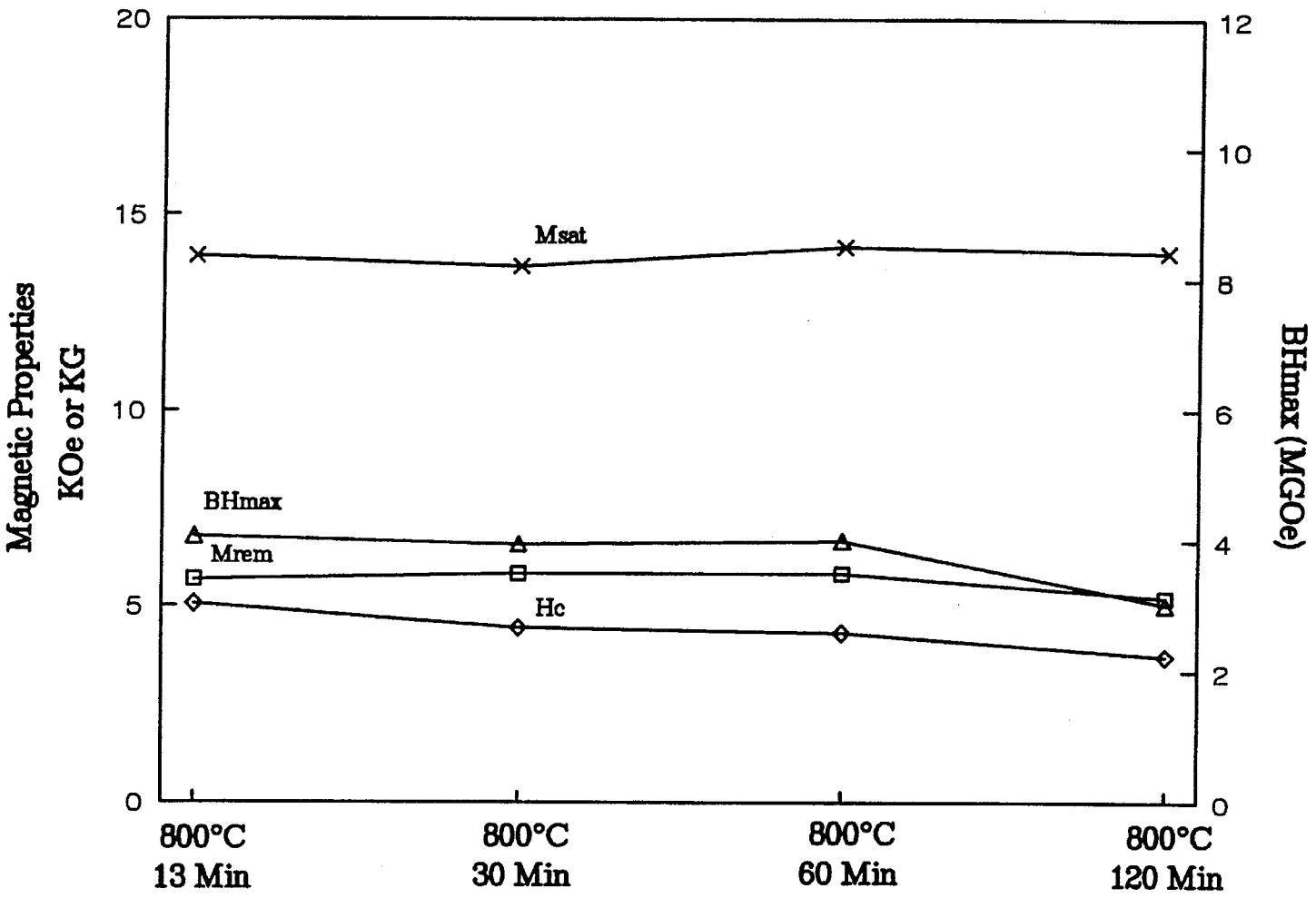
Figure 7J:
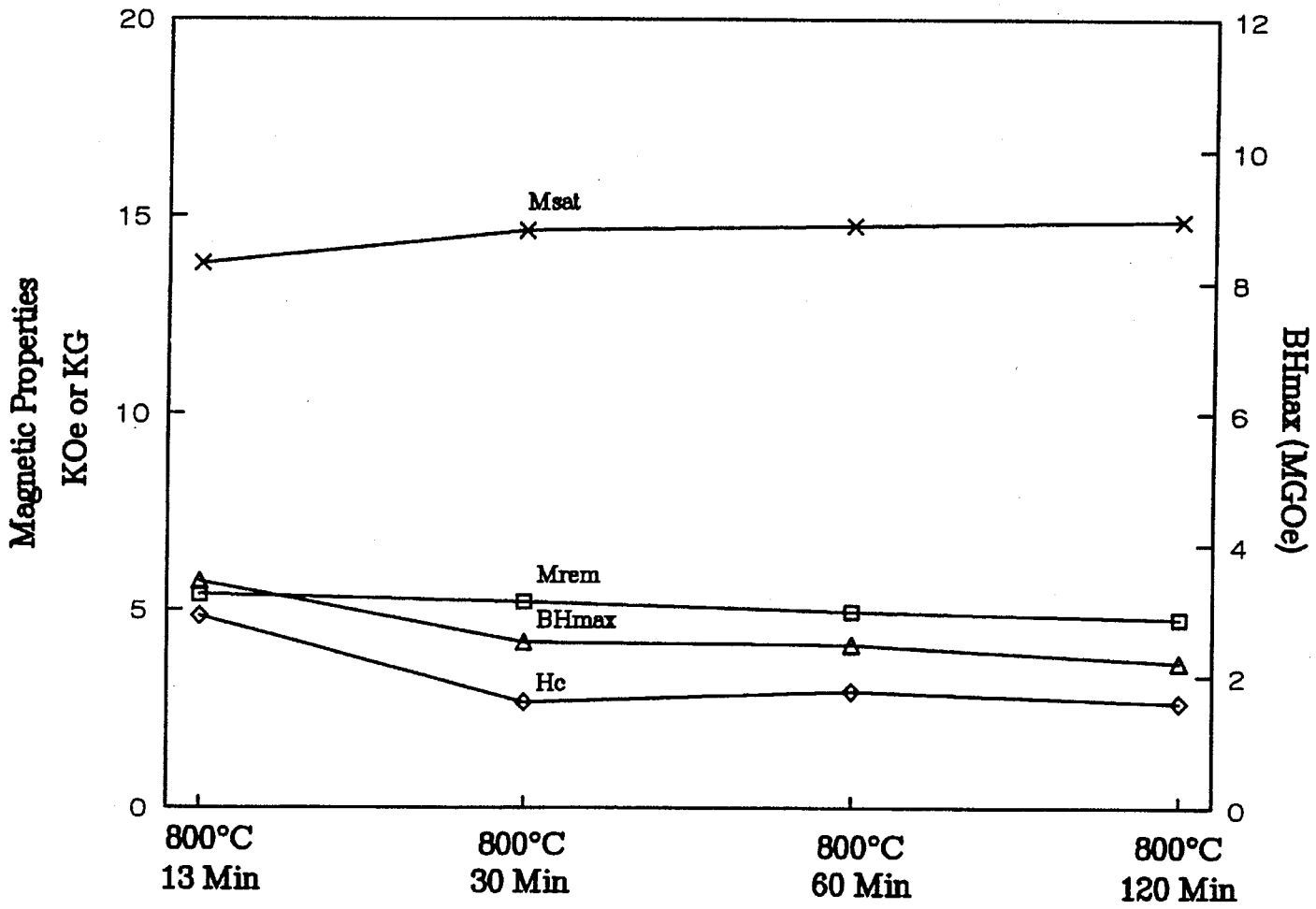
Figure 7K:
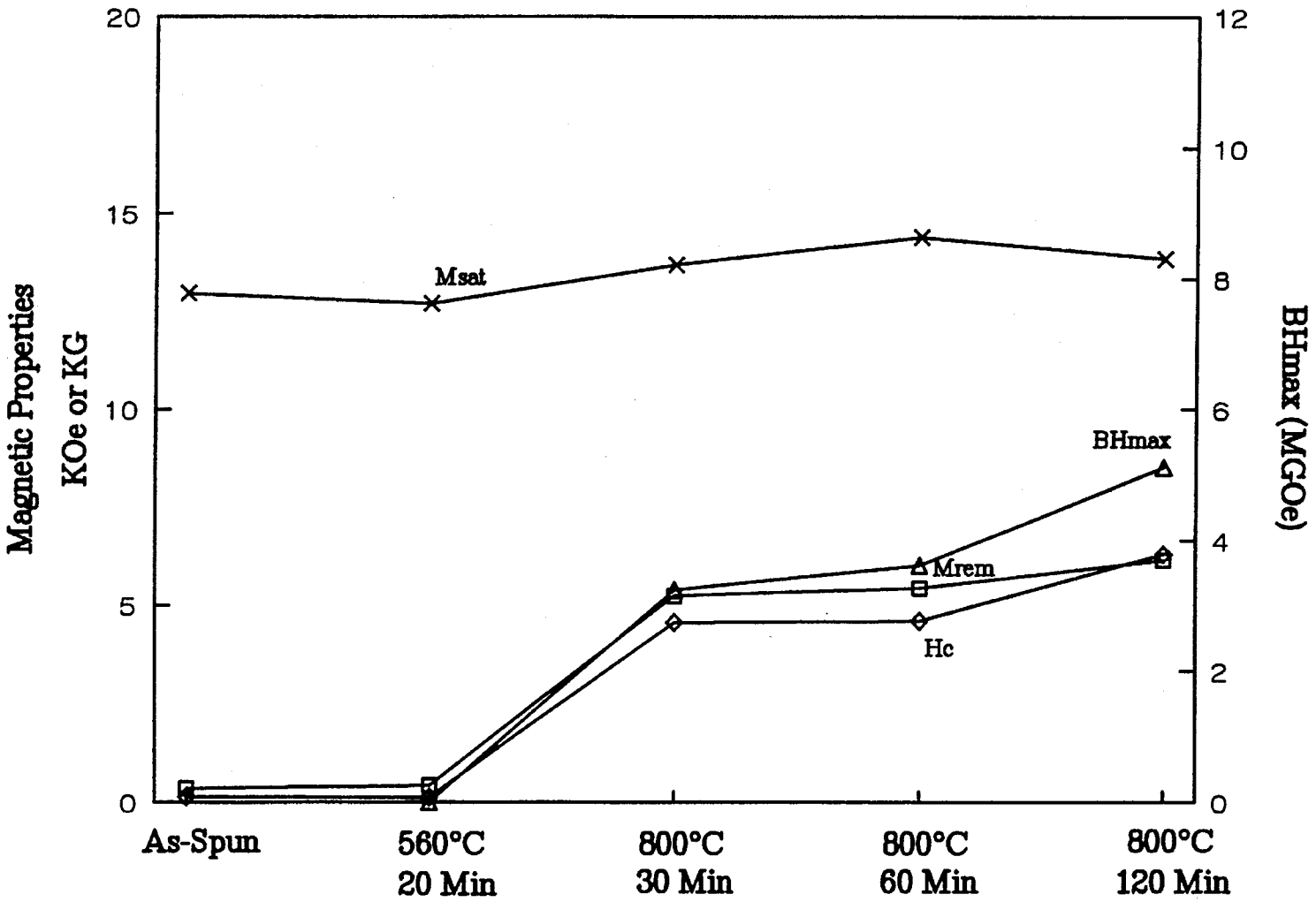
Figure 7L:
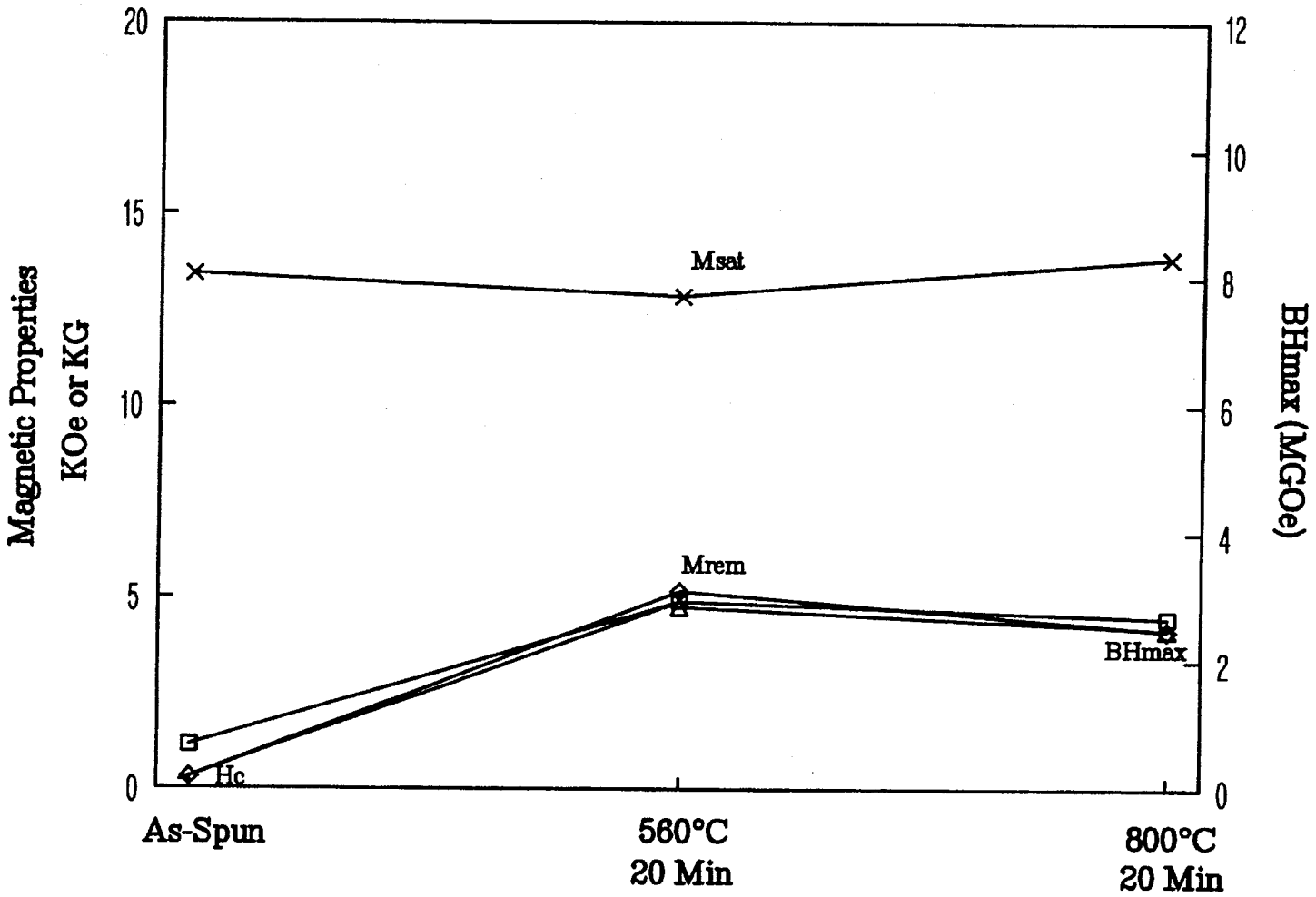

The homogenized ingot was contained in the quartz crucible of the melt-spinner with a 0.81 mm crucible melt outlet hole diameter. The melt was induction heated until a melt ejection temperature of 1375° C. was obtained. The alloy was then melt-spun with a crucible ejection pressure of 125 Torr onto the aforementioned copper chill wheel having a surface tangential wheel speed of 30 m/s. Rapidly solidified, flake-shaped particulates were produced in the size range of 1 to 3 cm. FIG. 7A is a graph of magnetic properties versus heat treatment temperatures/times for 2.4 wt % AlN added alloy.

EXAMPLES 4–12

Base Nd2Fe14B alloy melts were individually prepared in the same general manner as described above with respect to Examples 1–2 and various transition metals and C were introduced in elemental form to the base melts also in the same general manner as described above For example, in Example 4, 2.4 weight % of Hf and C were introduced. In Example 5, 2.4 weight % Mo and C were added to the base alloy melt. In Example 6, 2.4 weight % Nb and C were added to the base alloy composition. In Example 7, 2.4 weight % Ti and C were added to the base alloy melt.

In Example 8, 2.4 weight % Ti and N were added to the base alloy melt in the manner described above for Example 3.

In Example 9, 2.4 weight % Ta and C were added to the base alloy melt in the manner described above for Examples 1–2. In Example 10, 2.4 weight % V and C were added to the base alloy melt in the manner described above for Examples 1–2. In Example 11, 2.4 weight % W and C were added to the base alloy melt in the manner described above for Examples 1–2. In Example 12, 2.4 weight % Cr and C were added to the base alloy melt in the manner described in Examples 1–2.

The above melts were melt spun in the same general manner as described above for Examples 1–3 to form rapidly solidified, flake-shaped particulates in the size range of 1 to 3 cm.

FIGS. 7B–7L are graphs of magnetic properties versus heat treatment temperatures/times for the modified Nd2Fe14B alloy base compositions of Examples 4–12, respectively.

Figure 8A:
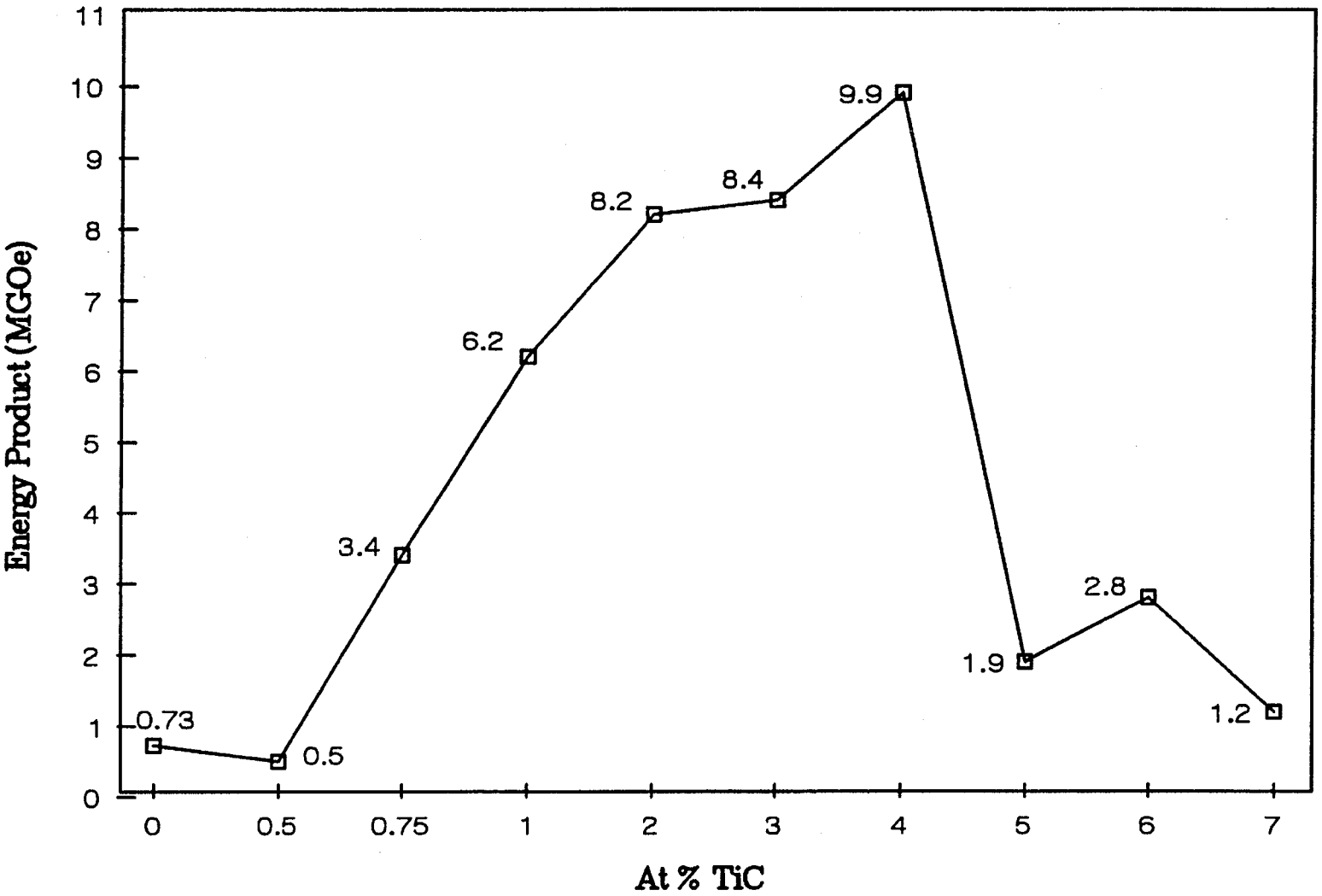
FIG. 8A and 8B are graphs of energy product versus atomic % TiC for as-cast (melt spun) Nd2Fe14B alloys after heat treatment at 800° C. for 2 and 4 hours, respectively.
Figure 8B:
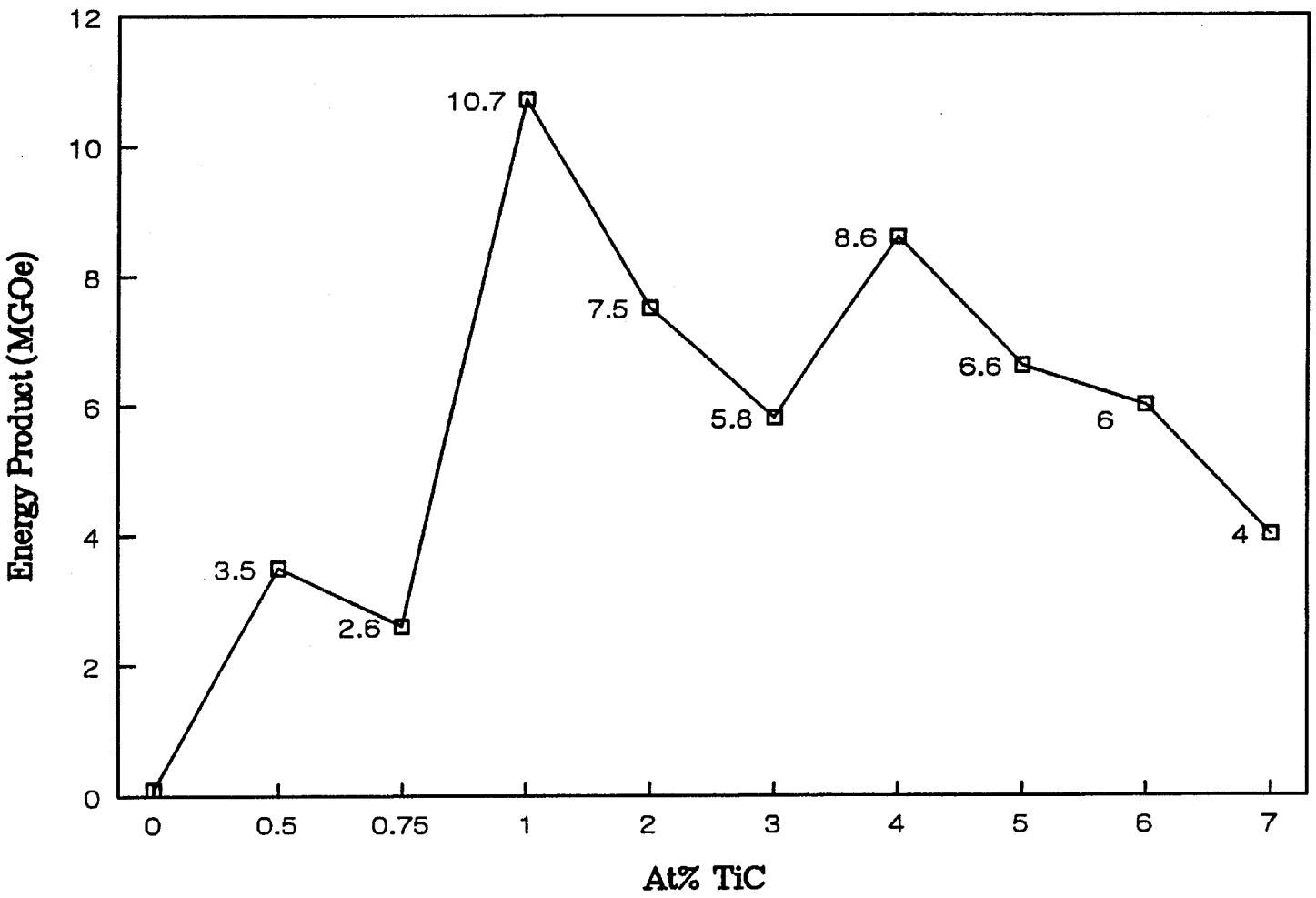

FIGS. 8A and 8B are graphs of energy product versus atomic % TiC for melt spun Nd2Fe14B alloys after heat treatment at 800° C. for 2 hours. The rapidly solidified Nd2Fe14B base alloy particulates including 0.5, 0.75 and 1.0, 2.0, 3.0, 4.0, 5.0, 6.0, and 7.0 atomic % TiC were made in the manner described above for Examples 1–2. The variations in energy product values represent variations in grain size occurring after heat treatment.

Figure 9A:
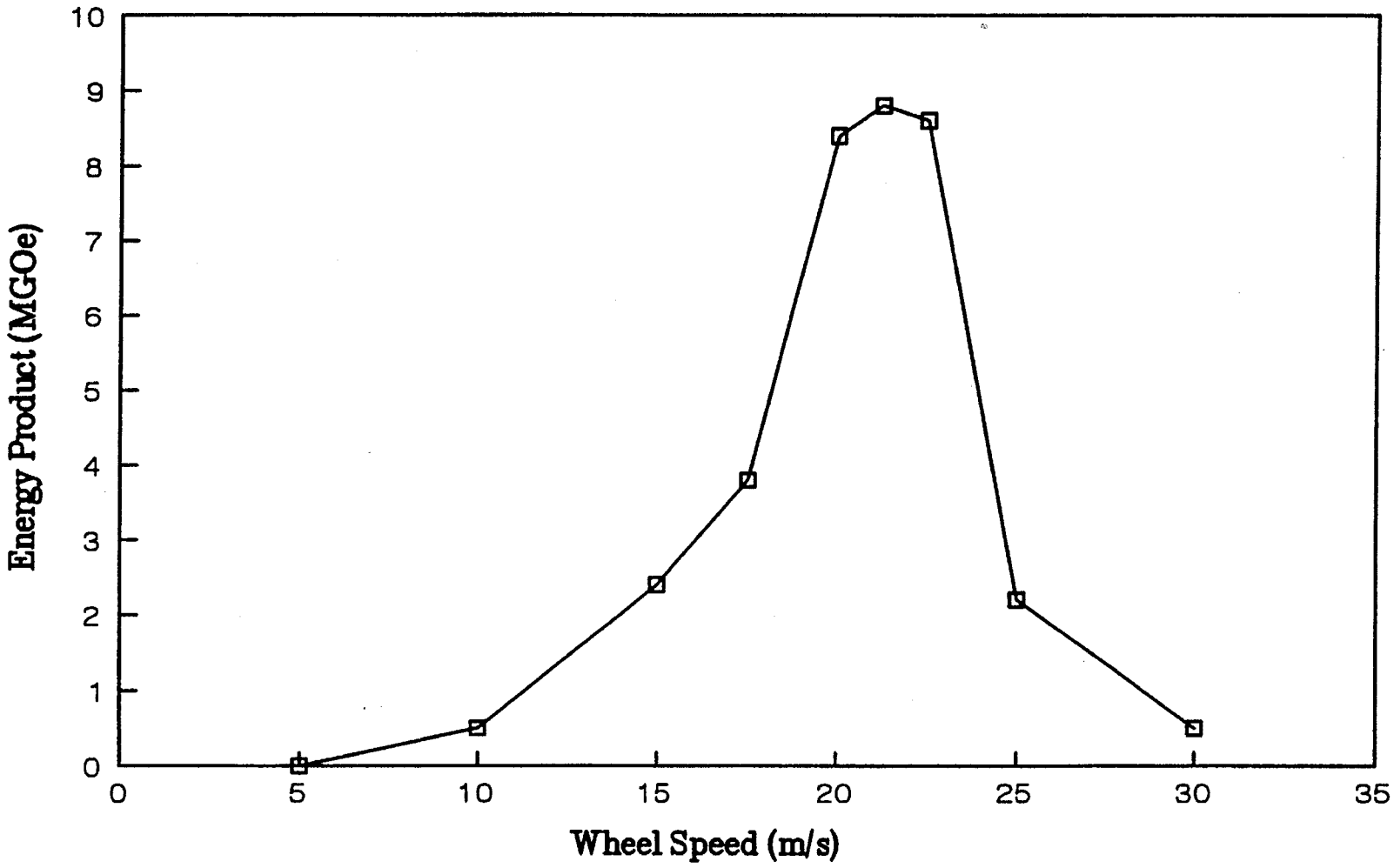
FIGS. 9A, 9B, and 9C are graphs of energy product versus wheel speed for melt spun unmodified Nd2Fe14B alloy, Nd2Fe14B alloy plus 2 atomic % TiC, and Nd2Fe14B alloy plus 6 atomic % TiC, respectively.
Figure 9B:
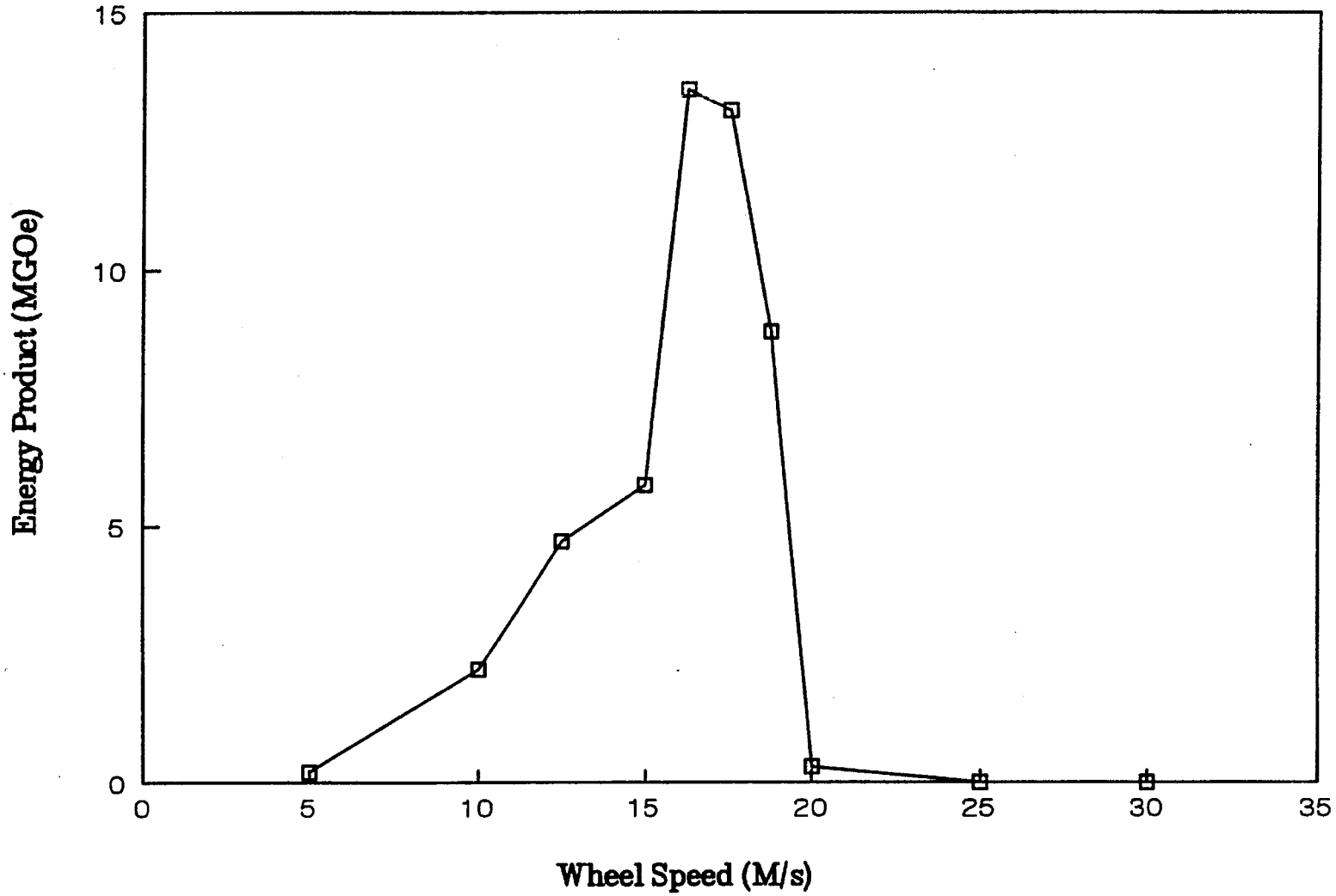
Figure 9C:
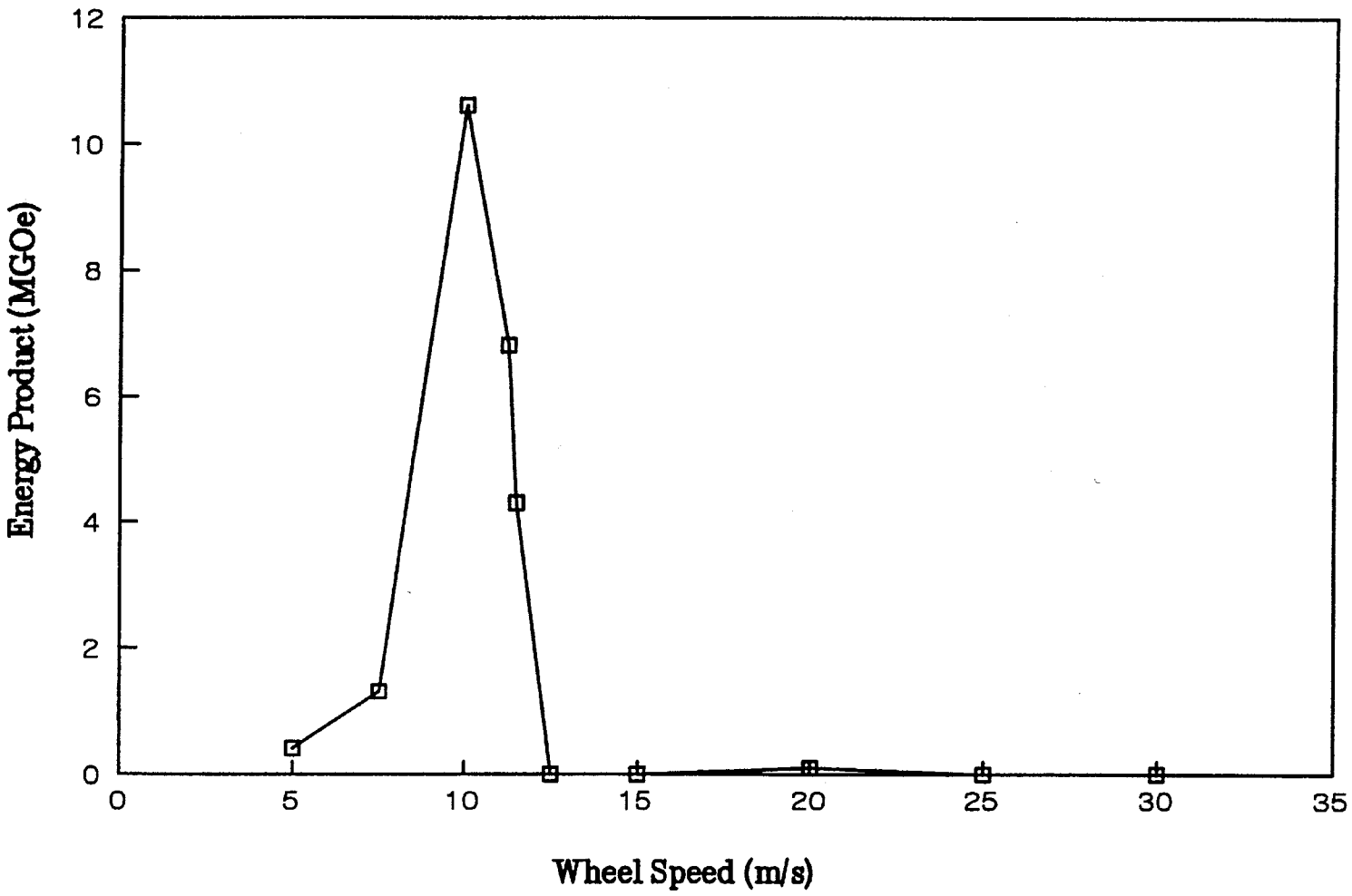

FIGS. 9A, 9B, and 9C are graphs of energy product versus wheel velocity for the melt spun unmodified Nd2Fe14B alloy, Nd2Fe14B alloy plus 2 atomic % TiC, and Nd2Fe14B alloy plus 6 atomic % TiC, respectively. From FIGS. 9A, 9B, and 9C, it can be seen that much improved glass forming ability occurs with Ti and C additions to the melt. The glass or partly crystalline structure yields low levels of energy product because the amorphous structure has no magnetocrystalline anisotropy.

Figure 10A:
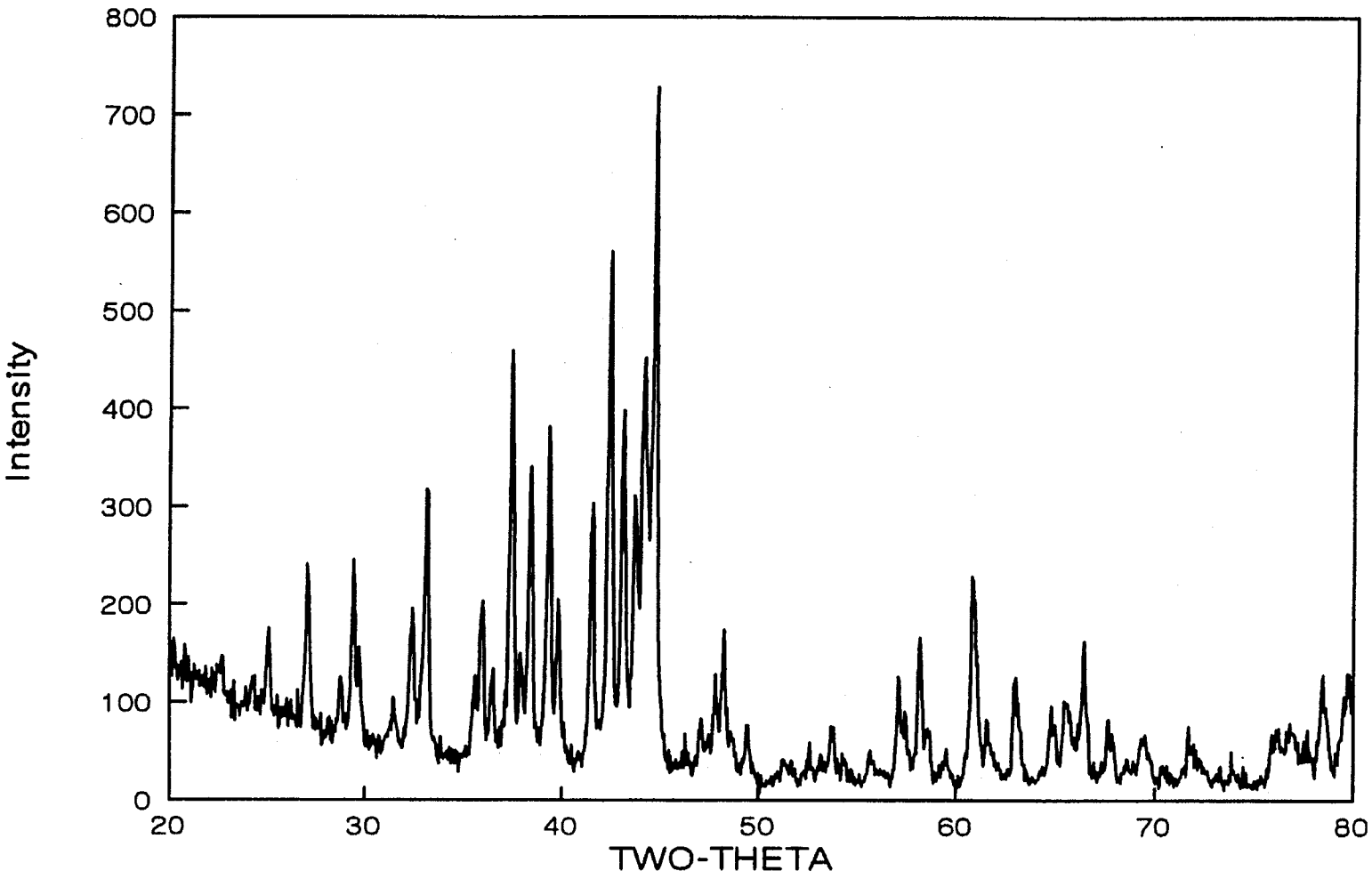
FIG. 10A, 10B, and 10C are X-ray diffraction scans for melt spun unmodified Nd2Fe14B alloy, Nd2Fe14B alloy plus 2 atomic % TiC, and Nd2Fe14B alloy plus 6 atomic % TiC, respectively, quenched at the same cooling rate corresponding to a wheel tangential velocity of 15 m/s.
Figure 10B:
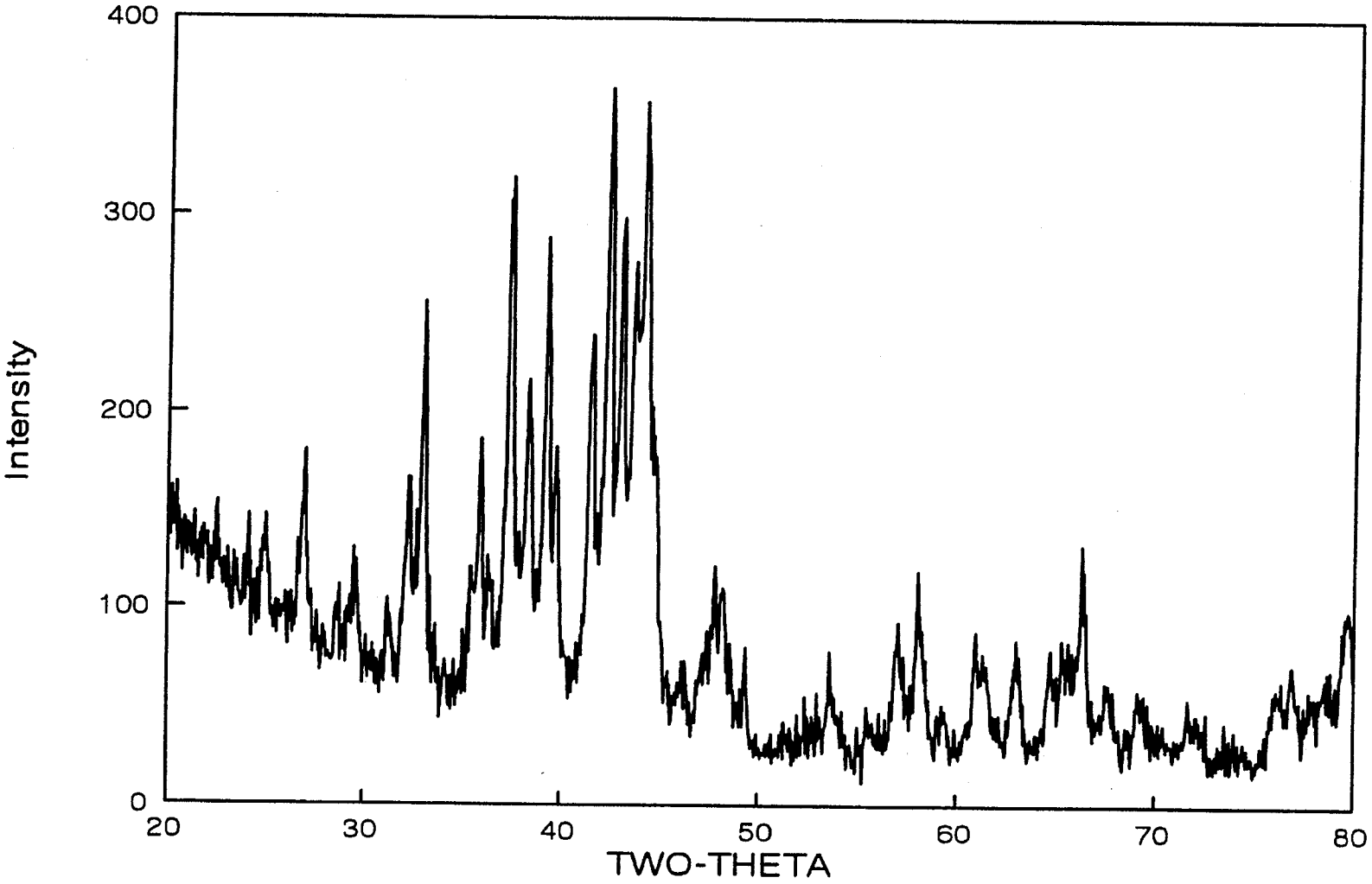
Figure 10C:
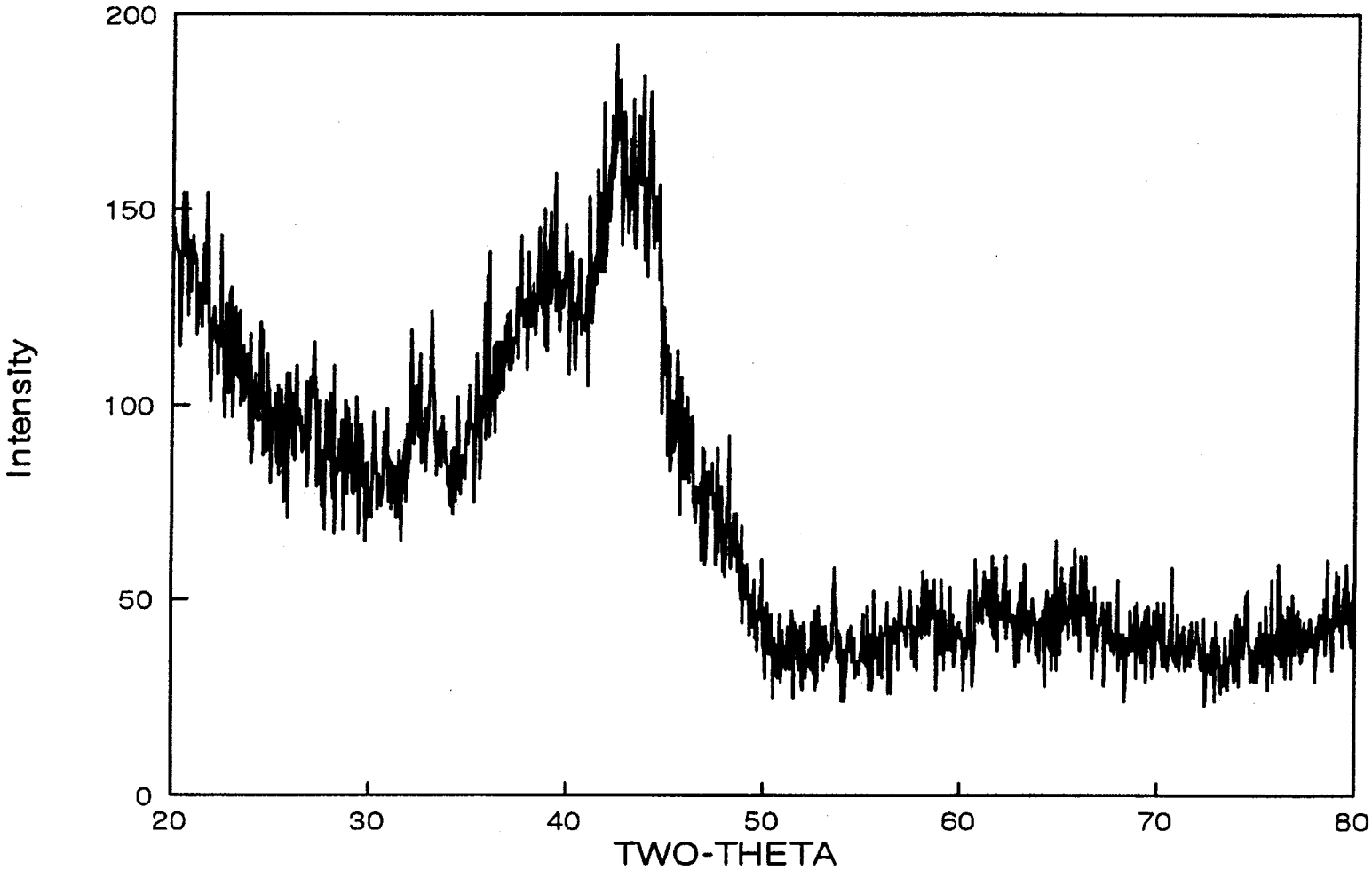

FIG. 10A, 10B, and 10C are X-ray diffraction scans for the melt spun unmodified Nd2Fe14B alloy, Nd2Fe14B alloy plus 2 atomic % TiC, and Nd2Fe14B alloy plus 6 atomic % TiC, respectively, quenched at the same cooling rate corresponding to a wheel tangential velocity of 15 m/s. Each X-ray diffraction scans were performed on alloys quenched at the same cooling rate. These figures illustrate the change in structure from crystalline to partly crystalline to glass caused by the Ti and C additions and illustrate the enhanced glass forming ability.

Figure 11:
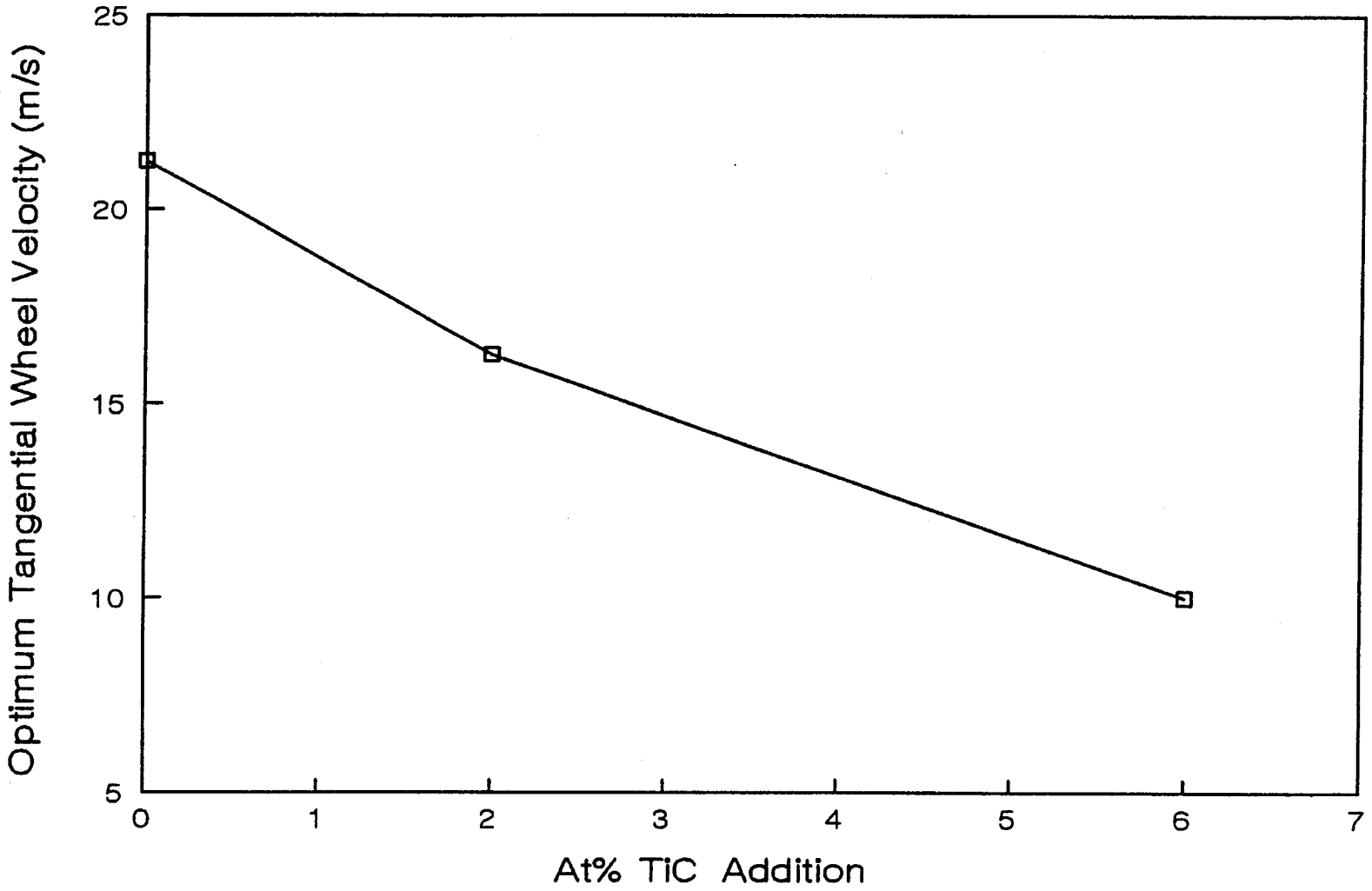
FIG. 11 is a graph of optimum tangential wheel velocity versus atomic % TiC in a melt spun Nd2Fe14B alloy.

FIG. 11 is a graph of optimum tangential wheel velocity versus atomic % TiC in the melt spun Nd2Fe14B alloy. This figure illustrates that the optimum cooling rate is reduced by the Ti and C addition to the base Nd2Fe14B composition. The optimum cooling rate is found to be reduced from 21.25 meters/second for the base alloy to 10 meters/second for the 6 atomic % TiC modified base alloy. This represents a reduction in optimum cooling rate of at least two orders of magnitude.

Figure 12:
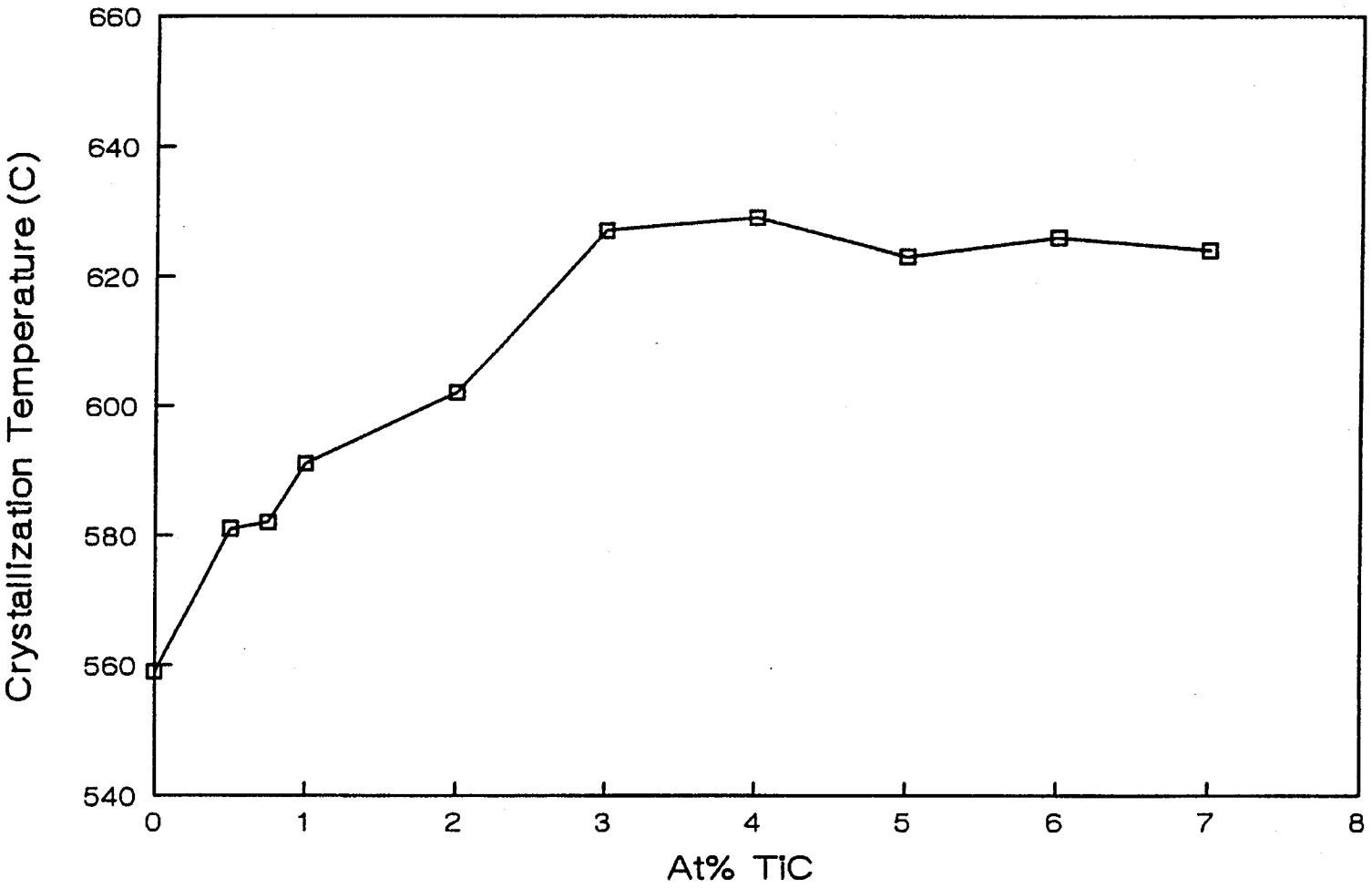
FIG. 12 is a graph of crystallization temperature versus atomic % TiC in melt spun Nd2Fe14B alloy.

FIG. 12 is a graph of crystallization temperature versus atomic % TiC in the melt spun Nd2Fe14B alloy. The leveling off of crystallization temperature after 3 atomic % TiC indicates the solubility limit of the liquid phase has been exceeded.

Figure 13:
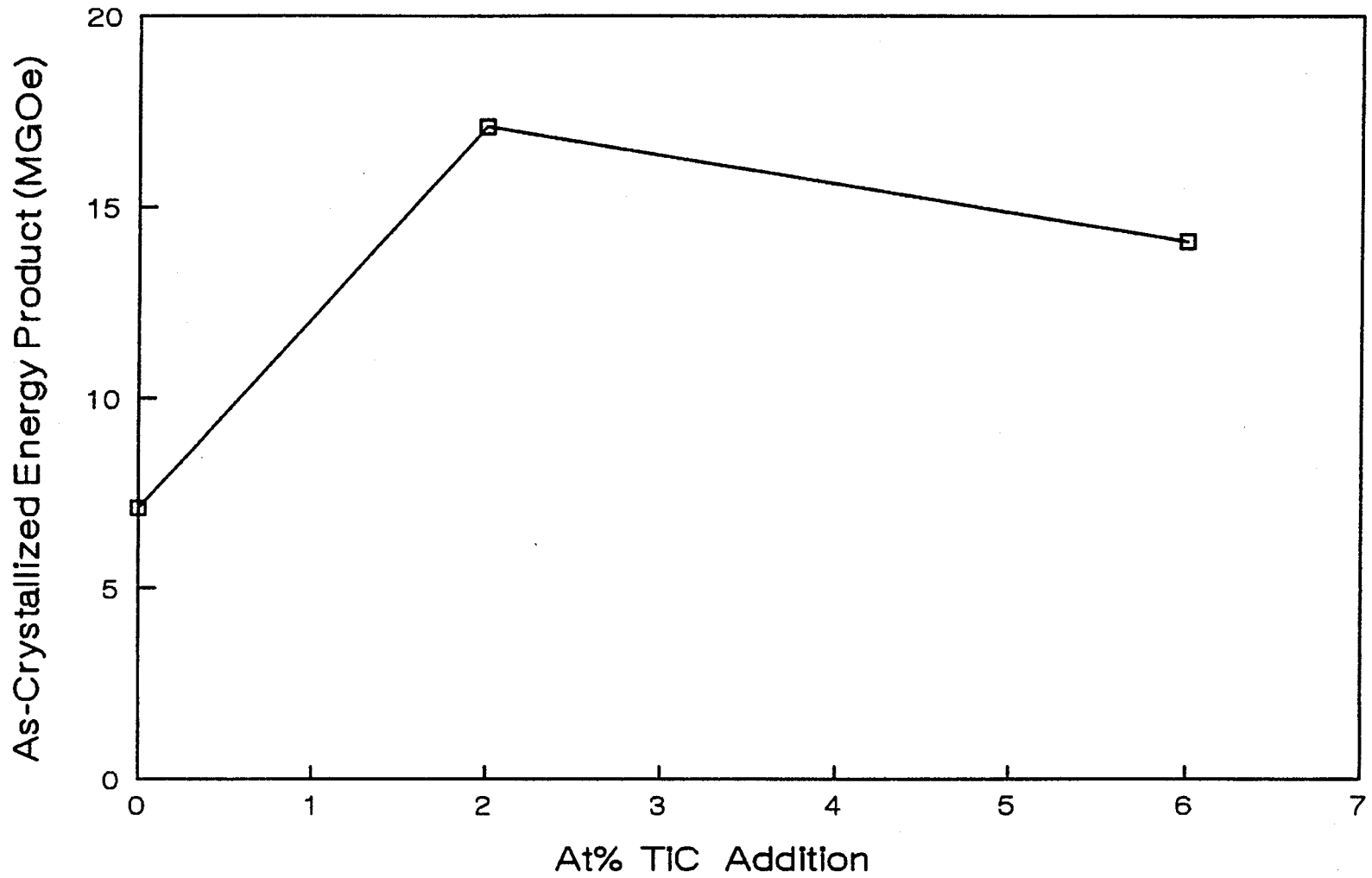
FIG. 13 is a graph of energy product versus atomic % TiC in an Nd2Fe14B alloy crystallized at 650° C. for 1 hour.

FIG. 13 is a graph of energy product versus atomic % TiC in the melt spun Nd2Fe14B alloys crystallized at 650° C. for 1 hour. This figure demonstrates that the as-crystallized energy product of the base alloy can be increased by the addition of Ti and C. This effect results from the finer nucleation grain size from the higher crystallization temperature caused by Ti and C additions.

Figure 14:
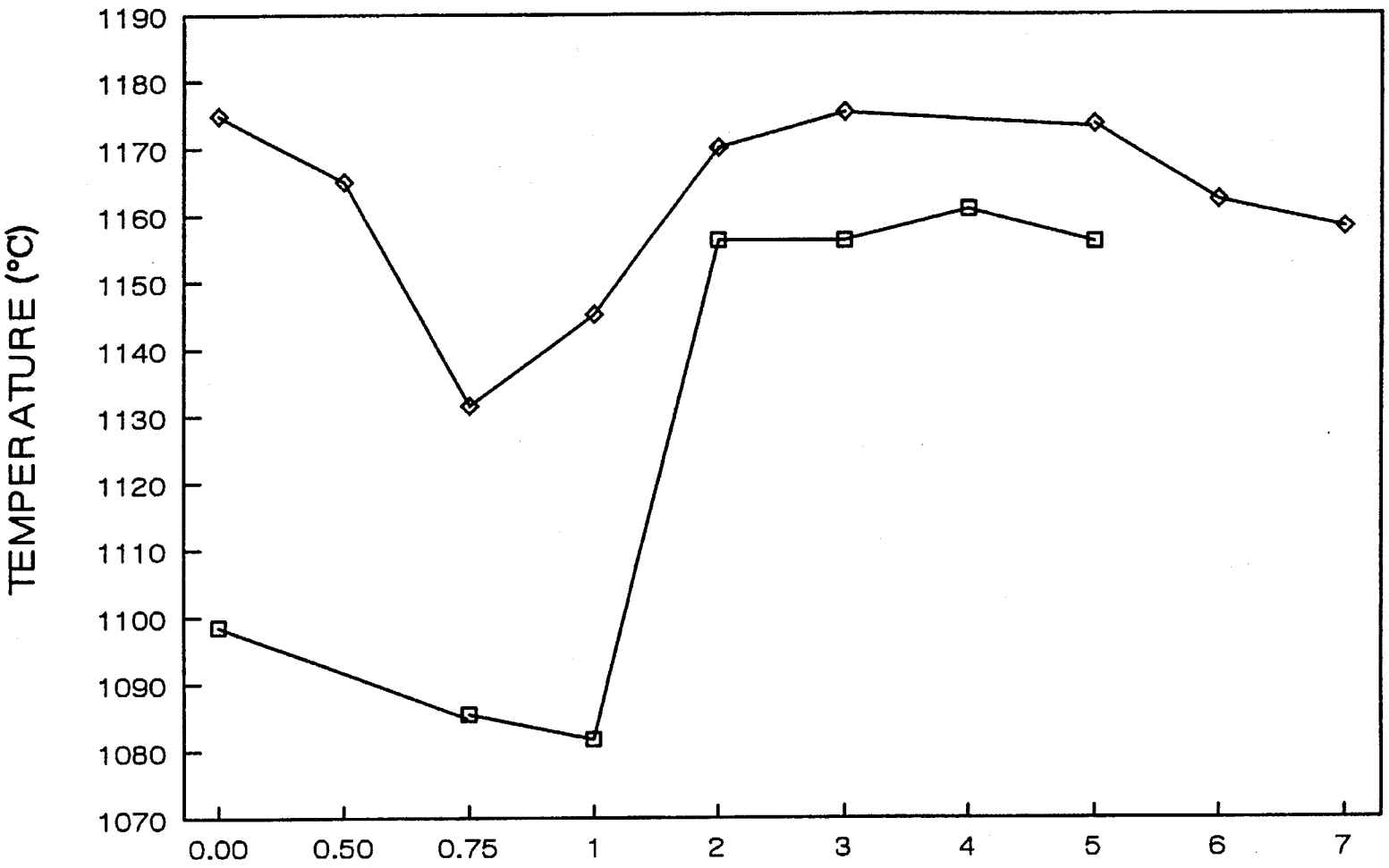
FIG. 14 is a graph of melting temperature versus atomic % TiC in melt spun Nd2Fe14B alloy.

FIG. 14 is a graph of melting temperature versus atomic % TiC in the melt spun Nd2Fe14B alloy. This figure illustrates the reduced peritectic melting range caused by Ti and C additions to the base alloy composition.

Figure 15A:
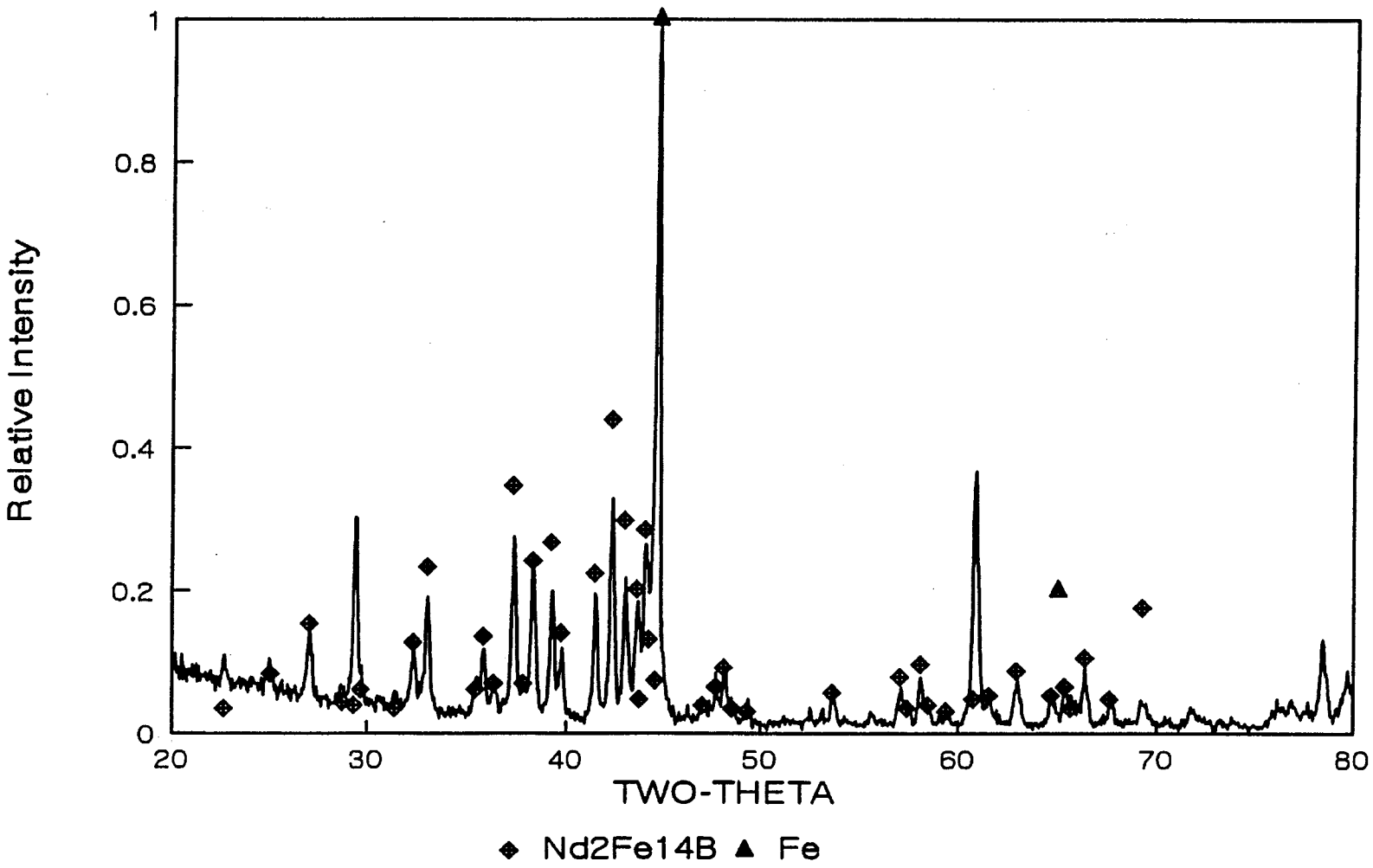
FIGS. 15A, 15B, and 15C are X-ray diffraction scans for melt spun unmodified Nd2Fe14B alloy, Nd2Fe14B alloy plus 2 atomic % TiC, and Nd2Fe14B alloy plus 6 atomic % TiC, respectively, quenched at the same cooling rate corresponding to a tangential wheel velocity equal to 10 m/s.
Figure 15B:
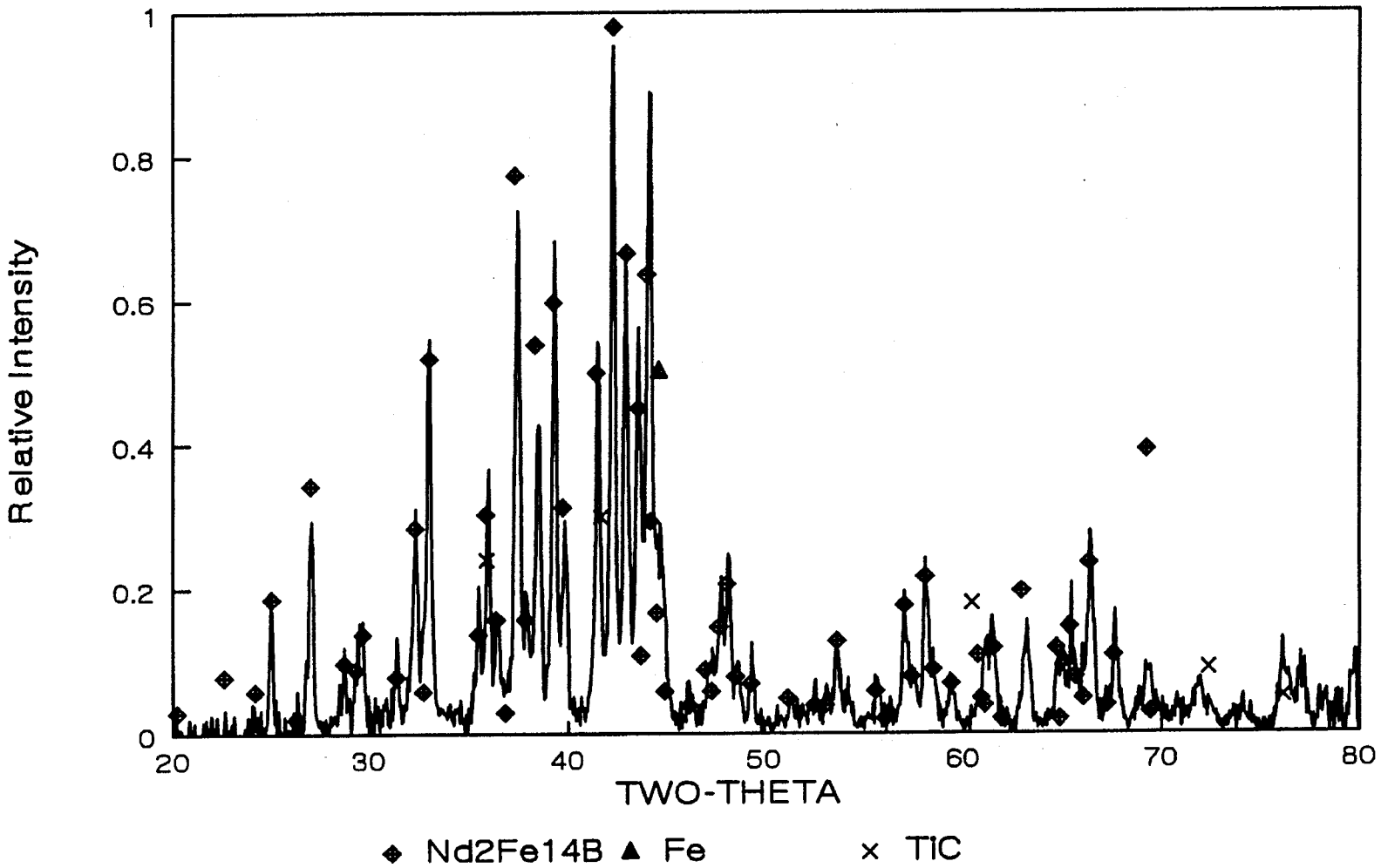
Figure 15C:
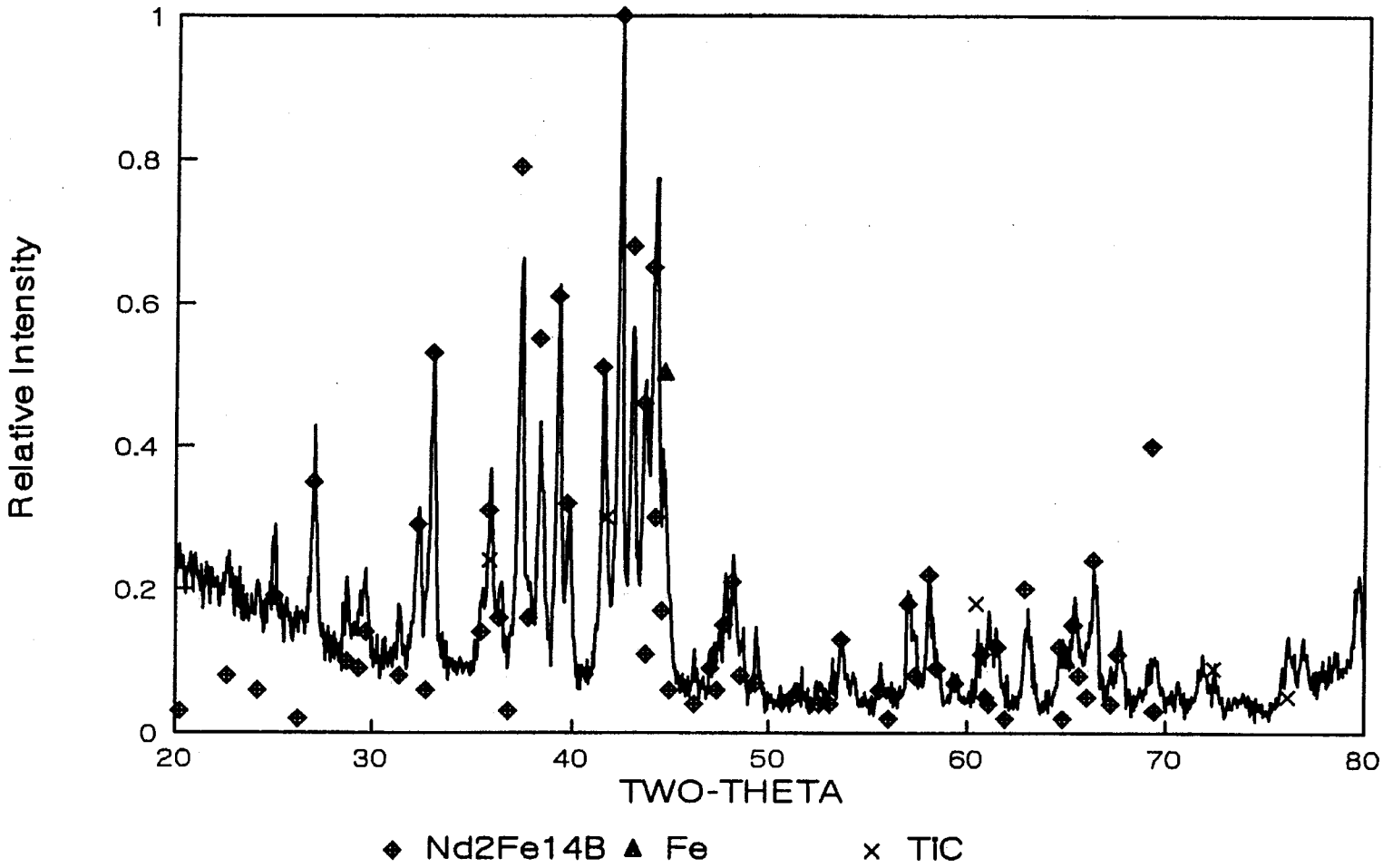

FIGS. 15A, 15B, and 15C are X-ray diffraction scans for the melt spun unmodified Nd2Fe14B alloy, Nd2Fe14B alloy plus 2 atomic % TiC, and Nd2Fe14B alloy plus 6 atomic % TiC, respectively, quenched at the same cooling rate corresponding to a wheel tangential velocity of 10 m/s. In the unmodified Nd2Fe14B alloy, properitectic iron is found to be present. In the 2 and 6 atomic % TiC modified base alloys, free iron phase is not observed in FIGS. 15B and 15C. These figures indicate the suppression of properitectic free iron as a result of the addition of Ti and C to the base alloy.

While the invention has been described in terms of specific embodiments thereof, it is not intended to be limited thereto but rather only to the extent set forth hereafter in the following claims.

The embodiments of the invention in which an exclusive property or privilege is claimed are defined as follows:

1. A method of making a permanent magnet having a base alloy composition comprising RE, at least one of Fe and Co, and B wherein RE is one or more rare earth elements, comprising:

a) forming a melt having said base alloy composition in which TR, where TR is a transition metal selected from the group consisting of Ti, Zr, Hf, V, Nb, Ta, Cr, Mo, W, and Al and at least one of C and N are provided as additives to form upon melt solidification a compound that is more thermodynamically stable than a compound otherwise formable between the additives and the base alloy components, whereby the base alloy components are not involved in formation of said compound, b) rapidly solidifying the melt in a manner to form particulates having at least one of a substantially amorphous structure and micro-crystalline structure, including forming primary precipitates comprising said compound by reaction of said TR and said at least one of said C and N, said precipitates being dispersed in said structure, c) heating the solidified particulates above the crystallization temperature of the base alloy composition to improve a magnetic property of said structure, including forming secondary precipitates comprising said compound at grain boundaries by reaction of said TR and said at least one of said C and N, and d) consolidating the particulates at an elevated temperature, said precipitates resisting grain growth in said structure at said elevated temperature.

2. The method of claim 1 wherein the TR and C additives are introduced in elemental form to the melt having the base alloy composition.

3. The method of claim 1 wherein a melt is formed having a base alloy composition including Nd2Fe14B in which Ti and C are provided in substantially; stoichiometric amounts relative to one another to form TiC.

4. The method of claim 3 wherein Ti and C are present in respective amounts of 0.1 and 15 weight % for Ti and 0.1 and 15 weight % for C.

5. The method of claim 1 wherein the melt is rapidly solidified by melt spinning to form said particulates.

6. The method of claim 1 wherein the melt is rapid solidified by gas atomizing to form said particulates.

7. In a method of making rapidly solidified material comprising RE, at least one of Fe and Co, and B as alloy components of a melt of said material wherein RE is one or more rare earth elements, the improvement for reducing the quench rate needed to rapidly solidify the melt to at least one of a substantially amorphous structure and micro-crystalline structure without changing the ratio of said alloy components in the material, comprising providing in the melt prior to rapid solidification TR, where TR is a transition metal selected from the group consisting of Ti, Zr, Hf, V, Nb, Ta, Cr, Mo, W and Al, and at least one of C and N in substantially stoichiometric amounts relative to formation of a compound comprising at least one of a transition metal carbide, nitride, and carbonitride, and rapidly solidifying the melt, including forming in said structure during rapid solidification precipitates comprising said compound by reaction of said TR and said at least one of C and N.

8. The method of claim 1 including reducing the amount of properitectic iron phase in the amorphous structure by providing stoichiometric amounts of Ti and C in the melt prior to rapid solidification.

9. In a method of making permanent magnet material comprising RE, at least one of Fe and Co, and B as alloy components of a melt of said material wherein RE is one or more rare earth elements, the improvement for increasing a magnetic property of said material without changing the ratio of said alloy components in said material, comprising providing in the melt TR, where TR is a transition metal selected from the group consisting of Ti, Zr, Hf, V, Nb, Ta, Cr, Mo, W and Al, and at least one of C and N in substantially stoichiometric amounts relative to formation of a compound comprising at least one of a transition metal carbide, nitride, and carbonitride effective to generally match the melt cooling rate needed to achieve said increased magnetic properties to the cooling rate provided by said rapid solidification, and rapidly solidifying the melt, including forming during rapid solidification precipitates comprising said compound by reaction of said TR and said at least one of C and N.

10. In a method of making rapidly solidified and crystallized material comprising RE, at least one of Fe and Co, and B as alloy components wherein RE is one or more rare earth elements, the improvement for increasing energy product of said material after crystallization without changing the ratio of said alloy components in said material, comprising providing in the melt prior to rapid solidification TR, where TR is a transition metal selected from the group consisting of Ti, Zr, Hf, V, Nb, Ta, Cr, Mo, W and Al, and at least one of C and N in substantially stoichiometric amounts relative to formation of a compound comprising at least one of a transition metal carbide, nitride, and carbonitride, rapidly solidifying the melt, including forming during rapid solidification precipitates comprising said compound by reaction of said TR and said at least one of C and N, and heating the rapidly solidified melt above its crystallization temperature.

11. In a method of making rapidly solidified and crystallized material comprising RE, at least one of Fe and Co, and B as alloy components wherein RE is one or more rare earth elements, the improvement for increasing the crystallization temperature without changing the ratio of said alloy components in the material, comprising providing in the melt prior to rapid solidification TR, where TR is a transition metal selected from the group consisting of Ti, Zr, Hf, V, Nb, Ta, Cr, Mo, W and Al, and at least one of C and N in substantially stoichiometric amounts relative to formation of a compound comprising at least one of a transition metal carbide, nitride and carbonitride, and rapidly solidifying the melt in a manner to form precipitates comprising said compound by reaction of said TR and said at least one of C and N, leaving a portion of the TR and said at least one of C and N in solid solution.

12. A method of making a particulates having a base alloy composition comprising RE, at least one of Fe and Co, and B as base alloy components wherein RE is one or more rare earth elements, comprising:

a) forming a melt having said base alloy composition in which TR, where TR is a transition metal selected from the group consisting of Ti,Zr, Hf, V, Nb, Ta, Cr, Mo, W, and Al and at least one of C and N are provided as additives to form upon melt solidification a compound that is more thermodynamically stable than a compound otherwise formable between the additives and the base alloy components, whereby the base alloy components are not involved in formation of said compound, and b) rapidly solidifying the melt in a manner to form particulates having at least one of a substantially amorphous structure and micro-crystalline structure, including forming precipitates dispersed in said structure and comprising said compound by reaction of said TR and said at least one of C and N.

13. The method of claim 12 further including heating the rapidly solidified particulates to improve a magnetic property of said structure, including forming additional precipitates comprising said compound by reaction of said TR and said at least one of C and N.

* * * * *